US005766813A

United States Patent [19]

Kunugi

[11] Patent Number: 5,766,813

[45] Date of Patent: Jun. 16, 1998

[54] DEVELOPING METHOD AND SYSTEM FOR TRANSFERRING TONER FROM A TONER CARRIER MEMBER TO A LATENT IMAGE CARRIER

[75] Inventor: Masanao Kunugi, Suwa, Japan

[73] Assignee: Seiko Epson Corporation, Tokyo, Japan

[21] Appl. No.: 658,085

[22] Filed: Jun. 4, 1996

Related U.S. Application Data

[60] Continuation-in-part of Ser. No. 439,185, May 11, 1995, Pat. No. 5,659,858, which is a division of Ser. No. 166,017, Dec. 14, 1993, Pat. No. 5,439,769.

[30] Foreign Application Priority Data

Dec. 16, 1992 [JP] Japan ..... 4-336384
Oct. 21, 1993 [JP] Japan ..... 5-263893

[51] Int. Cl.[6] ..... G03G 13/08

[52] U.S. Cl. ..... 430/102; 430/100; 430/101

[58] Field of Search ..... 430/100, 101, 430/102

[56] References Cited

U.S. PATENT DOCUMENTS

| | | | |
|---|---|---|---|
| 2,297,691 | 10/1942 | Carlson | 430/31 |
| 4,134,760 | 1/1979 | Gibson et al. | 430/109 |
| 4,426,436 | 1/1984 | Lewis et al. | 430/137 |
| 4,518,673 | 5/1985 | Noguchi | 430/108 |
| 4,935,782 | 6/1990 | Kohyaman | 430/110 |
| 4,943,504 | 7/1990 | Tomura et al. | 430/102 |
| 4,980,256 | 12/1990 | Kato et al. | 430/106.6 |

FOREIGN PATENT DOCUMENTS

| | | |
|---|---|---|
| 0098112 | 6/1983 | European Pat. Off. . |
| 0241160 | 3/1987 | European Pat. Off. . |
| 51-36070 | 10/1976 | Japan . |
| 52-36414 | 9/1977 | Japan . |
| 54-16219 | 6/1979 | Japan . |
| 55-18656 | 2/1980 | Japan . |
| 55-79454 | 6/1980 | Japan . |
| 55-159450 | 12/1980 | Japan . |
| 57-114163 | 7/1982 | Japan . |
| 60-45272 | 3/1985 | Japan . |
| 61-239272 | 10/1986 | Japan . |
| 61-277964 | 12/1986 | Japan . |
| 62-55146 | 11/1987 | Japan . |
| 63-62740 | 12/1988 | Japan . |
| 4-6953 | 2/1992 | Japan . |
| 4-145448 | 5/1992 | Japan . |
| 2258053 | 7/1992 | United Kingdom . |

OTHER PUBLICATIONS

Patent Abstracts of Japan, vol. 010, No. 162 (P–466), Jan. 23, 1996.

Patent Abstracts of Japan, vol. 012, No. 029 (P–660), Aug. 11, 1987.

*Primary Examiner*—Roland Martin

*Attorney, Agent, or Firm*—Sughrue, Mion, Zinn, Macpeak & Seas, PLLC

[57] ABSTRACT

A method and apparatus for developing a image from an electrostatic latent image formed on an image portion of a latent image carrier which is charged to a predetermined potential includes the steps of: supplying to a toner carrier member, toner comprising toner base particles, a first additive constituted by fine particles, and a second additive constituted by fine particles, wherein respective potentials of the toner carrier member, the toner base particles, the first additive and the second additive have a predetermined triboelectric series; using the predetermined triboelectric series to transfer the toner from the toner carrier member to the image portion of the latent image carrier; and developing the image from the transferred toner.

92 Claims, 25 Drawing Sheets

FIG. 8

PLUS SIDE
- TONER CARRIER E (BASE MATERIAL: EPDM, SURFACE: NYLON)
- TONER CARRIER D (BASE MATERIAL: EPDM, SURFACE: NICKEL ELECTRO-CAST TUBE)
- TONER CARRIER B (NBR)
- TONER CARRIER A (URETHANE RUBBER)
- TONER CARRIER C (BASE MATERIAL: EPDM, SURFACE: URETHANE RESIN)
- METAL BLADE MADE OF STAINLESS STEEL
- URETHANE SPONGE ROLLER
- OUTER ADDITION AGENT a
- TONER BASE PARTICLE A

MINUS SIDE

FIG. 9

PLUS SIDE
- OUTER ADDITION AGENT b
- TONER CARRIER B (NBR)
- TONER CARRIER A (URETHANE RUBBER)
- TONER CARRIER C (BASE MATERIAL: EPDM, SURFACE URETHANE RESIN)
- METAL BLADE MADE OF STAINLESS STEEL
- URETHANE SPONGE ROLLER
- TONER BASE PARTICLE A

MINUS SIDE

FIG. 10

PLUS SIDE
- TONER CARRIER E (BASE MATERIAL: SILICONE, SURFACE: NYLON RESIN)
- METAL BLADE MADE OF STAINLESS STEEL
- URETHANE SPONGE ROLLER
- TONER BASE PARTICLE A
- OUTER ADDITION AGENT c

MINUS SIDE

FIG. 11

PLUS SIDE
- TONER CARRIER D (BASE MATERIAL: EPDM, SURFACE: NICKEL ELECTRO-CAST TUBE)
- TONER CARRIER B (NBR)
- TONER CARRIER A (URETHANE RUBBER)
- TONER CARRIER C (BASE MATERIAL: EPDM, SURFACE: URETHANE RESIN)
- METAL BLADE MADE OF STAINLESS STEEL
- URETHANE SPONGE ROLLER
- TONER BASE PARTICLE A
- OUTER ADDITION AGENT c

MINUS SIDE

FIG. 12

PLUS SIDE
- METAL BLADE MADE OF STAINLESS STEEL
- URETHANE SPONGE ROLLER
- TONER BASE PARTICLE A
- TONER CARRIER F (BASE MATERIAL: SILICONE, SURFACE: FLUORORESIN)
- OUTER ADDITION AGENT c

MINUS SIDE

FIG. 14

PLUS SIDE
- TONER BASE PARTICLE B
- OUTER ADDITION AGENT b
- METAL BLADE MADE OF STAINLESS STEEL
- URETHANE SPONGE ROLLER
- TONER CARRIER G (EPDM)
- TONER CARRIER H (SILICONE)

MINUS SIDE

FIG. 15

PLUS SIDE
- TONER BASE PARTICLE B
- METAL BLADE MADE OF STAINLESS STEEL
- URETHANE SPONGE ROLLER
- TONER CARRIER G (EPDM)
- TONER CARRIER H (SILICONE)
- OUTER ADDITION AGENT c

MINUS SIDE

FIG. 16

PLUS SIDE
- OUTER ADDITION AGENT d
- TONER BASE PARTICLE B
- METAL BLADE MADE OF STAINLESS STEEL
- URETHANE SPONGE ROLLER
- TONER CARRIER F (BASE MATERIAL: SILICONE, SURFACE: FLUORORESIN)

MINUS SIDE

FIG. 17

PLUS SIDE
- OUTER ADDITION AGENT d
- TONER BASE PARTICLE B
- METAL BLADE MADE OF STAINLESS STEEL
- URETHANE SPONGE ROLLER
- TONER CARRIER G (EPDM)
- TONER CARRIER H (SILICONE)

MINUS SIDE

FIG. 18

PLUS SIDE
- OUTER ADDITION AGENT d
- TONER CARRIER E (BASE MATERIAL: SILICONE, SURFACE: NYLON RESIN)
- TONER BASE PARTICLE B
- METAL BLADE MADE OF STAINLESS STEEL
- URETHANE SPONGE ROLLER

MINUS SIDE

DEVELOPING METHOD AND SYSTEM FOR TRANSFERRING TONER FROM A TONER CARRIER MEMBER TO A LATENT IMAGE CARRIER

This is a Continuation-in-Part of application Ser. No. 08/439,185 filed May 11, 1995, now U.S. Pat. No. 5,659,858, which is a divisional of application Ser. No. 08/166,017 filed Dec. 14, 1993, now U.S. Pat. No. 5,439,769.

BACKGROUND OF THE INVENTION

1. Field of the Invention

The present invention relates to an electrophotographic process and apparatus, particularly to a developing method and system in which an electrostatic latent image is visualized on the latent image carrier by transferring, from a toner carrier member, toner constituted by a toner base particle and colorant. More particularly, the present invention relates to the relationship in an electrification rank among a toner carrier member, colorant constituting toner, a toner base particle and at least one additive.

2. Description of the Related Art

In electronic photography, heretofore, a large number of methods based on the Carlson's process disclosed in U.S. Pat. No. 2,297,691 have been proposed. In general, an electrostatic latent image is formed on a photosensitive material using a photoconductive substance. Then, fine powder called "toner" is selectively deposited on the latent image to perform development to thereby make the latent image visible. After toner for making the latent image visible is transferred to a transfer material such as paper or the like as occasion demands, the toner is fixed by heat and pressure or by solvent vapor to thus obtain a matter on which an image is formed.

Development methods of making the electrostatic latent image on the photosensitive material visible are roughly classified into dry developing methods, a magnetic brush developing method, a cascade developing method and so on are known as a two-component developing method using a carrier. Further, a jumping developing method, a FEED developing method, a magnetic brush developing method and so on are known as a one-component developing method. As toner for making the electrostatic latent image visible, negative toner or positive toner is used. As a development system, positive development and reversal development are used.

Particularly as a developing method in which toner is formed as a thin layer on a toner carrier member by a regulating member, and the toner is conveyed to a latent image carrier to thereby make a latent image visible, various kinds of methods have been disclosed in Japanese Patent Post Examination Publication No. Sho-52-36414, Japanese Patent Unexamined Publication Nos. Sho-57-114163, Sho-54-43027 and Sho-55-18656, and so on. In these aforementioned developing methods, carrier particles as used in the two-component developing method are not used, so that electric charges must be given to toner efficiently by a toner carrier member, a toner layer (thickness) regulating member and a supply member.

To solve this problem, theretofore, various proposals have been made. For example, in Japanese Patent Post-examined Publication No. Sho-51-36070, a doctor blade disposed far from toner with respect to triboelectric series is used. In Japanese patent Post-examined Publication No. Hei-4-6953, a material of a non-magnetic sleeve disposed far from the triboelectric series of toner. In Japanese Patent Unexamined Publication No. Sho-60-45272, an electrification member provided under the consideration of a triboelectric series caused by friction against a developer is applied onto a carrier surface and layer-regulating member.

In Japanese Patent Unexamined Publication No. Sho-61-239272, there is a proposal in which a fluidization assistant being enough near but free from triboelectric charge in the point of view of triboelectric series of the toner layer (thickness) regulating member is used. With respect to a surface additives provided in the surface portion of toner, use of silica is popularized to give fluidity to toner to thereby form a high-quality image. With respect to the surface additives, however, various proposals for improvement have been made. For example, in Japanese Patent Post-examined Publication No. Sho-54-16219, Japanese Patent Unexamined Publication Nos. Sho-55-159450 and Sho-61-277964 and so on, negatively-charge toner obtained by hydrophobing silica with dimethydichlorsilane, hexamethyldisilane and silicone oil is disclosed.

Further, in Japanese Patent Unexamined Publication No. Sho-55-79454, a developing agent having a surface treated with organic acid having carbon fluoride groups in order to change the triboelectric series thereof to thereby prevent filming is disclosed. Further, in Japanese Patent Post-examined Publication Nos. Sho-63-62740 and Hei. 4-145448, toner in which the state of deposition of the surface additives is limited is disclosed. There is however no improvement but an improvement in the relationship between the triboelectric series of toner carrier member and toner, an improvement in surface treatment of the surface additives, and the like. Even in the case where the aforementioned method are used, there arises a problem in that it is difficult to reduce deposition of toner onto a nonimage portion, that is, it is difficult to reduce fogging in the ground. Further, the aforementioned methods are weak against the change of time and the change of environment. There arises a problem in that it is difficult to provide stably a high-quality image free from fogging in the ground. Causes of such problems, however, have been not made clear yet.

Furthermore, a variety of proposals have been made as improvements in view of a colorant of toner, for example adoption of a colorant sufficiently electrifiable and efficient electrification by mixing a colorant with an improver of electrifiability have been proposed. However, in a case where pigment is used for a colorant, a colorant readily causes secondary solidification in a toner base particle and as a result, a solid is exposed to the surface of the toner base particle or detached from the toner base particle. Detached colorant and the surface of the toner base particle to which colorant is exposed electrostatically adhere to an electrified member such as a toner carrier member. In a developing system adopting a frictional electrification method, colorant further readily adheres to a toner carrier member because mechanical stress is applied to the toner. Such adherent colorant and the surface of the toner base particle to which colorant is exposed destabilize the state of electrification of a toner carrier member; as a result, they destabilize the state of electrification of a toner base particle and increase the ratio of background fog.

As an improvement in view of these, coating colorant to prevent secondary solidification and to prevent colorant from being exposed to the surface of a toner base particle as disclosed in Japanese published unexamined patent application No. S56-80055 has been proposed. However, in a developing system adopting a frictional electrification method, there is the problem that the surface colorant is exposed, its coating is detached, long-term stable electrification is disabled and background fog is increased due to application of mechanical stress to toner according to the conventional proposal in relation to coating colorant.

SUMMARY OF THE INVENTION

As a result of eager investigation to solve the aforementioned problems, according to the present invention, it has been found that fogging and triboelectric series have a large correlation.

It is therefore an object of the present invention to provide a developing system and method in which deposition of toner onto a non-image portion is avoided, that is, fogging is avoided. It is another object of the present invention to provide a developing method which is excellent in durability, in which efficient electrification is enabled, and a satisfactory image with little background fog can be printed even if colorant and the surface of the toner base particle to which colorant is exposed adhere to a member electrifying toner such as a toner carrier member, so that image deterioration such as fogging is avoided in long-term continuous use.

It is another object of the present invention to provide high-quality images stably for a long term even under the environment of a high temperature and a high humidity and under the environment of a lower temperature and a low humidity.

According to the present invention, there is provided a developing method of the type in which negative toner constituted by a toner base particle including colorant and surface additives is transferred to a latent image carrier by using a toner carrier member to make an electrostatic latent image on the latent image carrier visible, characterized in that:

(1) respective triboelectric series of the toner carrier member, the toner base particle, colorant, and the surface additives have a relationship in which the toner carrier member, the surface additives and the toner base particle is the order of triboelectric series from the plus side, and wherein the triboelectric series of the colorant is greater than that of the toner base particle, but may be greater than or less than either of the triboelectric series of the toner carrier member and the surface additives;

(2) respective triboelectric series of the toner carrier member, the toner base particle, colorant, and the surface additives have a relationship in which the toner carrier member, the toner base particle and the surface additives is the order of triboelectric series from the plus side, and wherein the triboelectric series of the colorant is greater than that of the toner base particle, but may be greater than or less than the triboelectric series of the toner carrier member; or (3) respective triboelectric series of the toner carrier member, the toner base particle and the surface additives have a relationship in which the toner base particle, the toner carrier member and the surface additives is the order of triboelectric series from the plus side.

According to another embodiment which relates to positive toner having reverse polarity to the aforementioned embodiment of the present invention, there is provided a developing method of the type in which positive toner constituted by a toner base particle including colorant and a surface additives are transferred to a latent image carrier by using a toner carrier member to make and electrostatic latent image on the latent image carrier visible, characterized in that:

(4) respective triboelectric series of the toner carrier member, the toner base particle, colorant and the surface additives have a relationship in which the toner carrier member, the surface additives and the toner base particle is the order of triboelectric series from the minus side, and wherein the triboelectric series of the colorant is greater than that of the toner base particle, but may be greater than or less than either of the triboelectric series of the toner carrier member and the surface additives;

(5) respective triboelectric series of the toner carrier member, the toner base particle, colorant and the surface additives have a relationship in which the toner carrier member, the toner base particle, and the surface additives is the order of triboelectric series from the minus side, and wherein the triboelectric series of the colorant is greater than that of the toner base particle, but may be greater than or less than the triboelectric series of the toner carrier member; or (6) respective triboelectric series of the toner carrier member, the toner base particle and the surface additives have a relationship in which the toner base particle, the toner carrier member and the surface additives is the order of triboelectric series from the minus side.

BRIEF DESCRIPTION OF THE DRAWINGS

FIG. 8 is a view showing a relationship between the triboelectric series of the member used in Experimental Example 1 according to the present invention;

FIG. 9 is a view showing a relationship between the triboelectric series of the members used in Comparative Example 1 with respect to the present invention;

FIG. 10 is a view showing a relationship between the triboelectric series of the members used in Experimental Example 3 according to the present invention;

FIG. 11 is a view showing a relationship between the triboelectric series of the members used in Comparative Example 2 with respect to the present invention;

FIG. 12 is a view showing a relationship between the triboelectric series of the members used in Experimental Example 5 according to the present invention;

FIG. 14 is a view showing a relationship between the triboelectric series of the members used in Experimental Example 6 according to the present invention;

FIG. 15 is a view showing a relationship between the triboelectric series of the members used in Comparative Example 3 with respect to the present invention;

FIG. 16 is a view showing a relationship between the triboelectric series of the members used in Experimental Example 8 according to the present invention;

FIG. 17 is a view showing a relationship between the triboelectric series of the members used in Comparative Example 4 with respect to the present invention;

FIG. 18 is a view showing a relationship between the triboelectric series of the members used in Experimental Example 10 according to the present invention.

DESCRIPTION OF THE PREFERRED EMBODIMENTS

The present invention will be described below in detail on the basis of embodiments with reference to the drawings. "Negative toner" according to the present invention means toner which is such that toner on a toner carrier member is transferred to an area for making an electrostatic latent image on a latent image carrier visible (hereinafter referred to as "image portion") to thereby make the electrostatic latent image visible when the electric field between an image section on the latent image carrier and the toner carrier member is directed from the latent image carrier to the toner carrier member. In the following, the case of use of negative toner will be described.

Figure 1C:
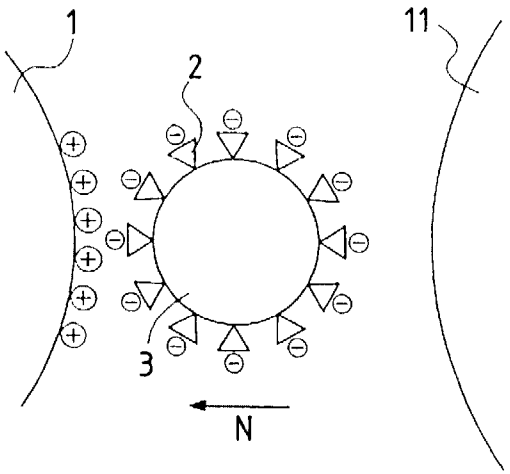
FIG. 1C is a view showing the charge polarity where the surface additives are deposited on a surface of the toner carrier member using the electrification ranking shown in FIG. 1A.
Figure 1B:
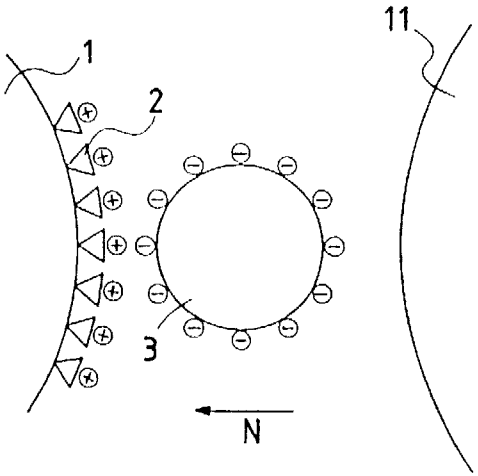
FIG. 1B is a view showing the charge polarity where the surface additives are not deposited on a surface of the toner carrier member using the electrification ranking shown in FIG. 1A.
Figure 1A:
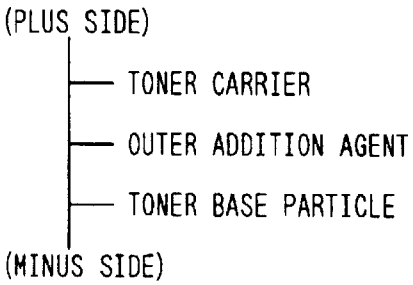
FIG. 1A is a view showing first relationship between triboelectric series of a toner carrier member, surface additives and a toner base particle used in a developing method using negative toner according to the present invention.

FIG. 1A shows a first triboelectric series relationship according to the first embodiment of the present invention. FIGS. 1A, 1B and 1C typically show the relationship of the charge polarity between a toner carrier member 1, surface additives 2 and a toner base particle 3 in a development apparatus.

In the case where the surface additives 2 are departed from the toner base particle 3 and deposed on a surface of the toner carrier member 1 as shown in FIG. 1B, the toner base particle 3 comes into contact with the surface additives 2 on the surface of the toner carrier member 1 and is negatively charged on the basis of the relationship in FIG. 1A, so that the toner base particle 3 is moved to the image portion on the latent image carrier 11 by electric field N so as to be used in order to make the latent image visible. Reversely, the surface additives 2 on the surface of the toner carrier member 1 are positively charged. Accordingly, the toner base particle 3 is prevented from being positively charged as a cause of fogging in the ground, so that it is used as negative toner for making the latent image on the latent image carrier 11 visible.

On the other hand, in the case where the surface additives 2 are not deposited on the toner carrier member 1 as shown in FIG. 1C, the surface additives 2 and the toner base particle 3 being in contact with the toner carrier member 1 are negatively charged in connection with FIG. 1A, so that they are used in order to make the latent image on the latent image carrier 11 visible in the same manner as in FIG. 1B. As described above, by arranging the respective members so that the relationship of order of the triboelectric series of the toner carrier member 1, the toner base particle 3 and the surface additives 2 is as shown in FIG. 1A, no positively-charged toner base particle 3 is generated regardless of the presence or absence of the surface additives 2 deposited on the surface of the toner carrier member 1. Accordingly, unnecessary toner can be prevented from being deposited on a non-image portion, that is, fogging in the ground can be eliminated.

Further, according to the present invention, plural types of additives can be used in the relationship in an electrification rank among an additive, a toner base particle and a toner carrier member. In particular, a pigment particle functions as an additive in that a pigment particle detached from a toner base particle may adhere to the surface of a toner carrier member or a toner base particle with the other pigment particles existing in the toner, and that such a pigment particle further has an effect on the electrification of toner, although a pigment particle differs from the aforementioned additives in that a pigment particle detached from a toner base particle originally exists in a toner base material.

Figure 1F:
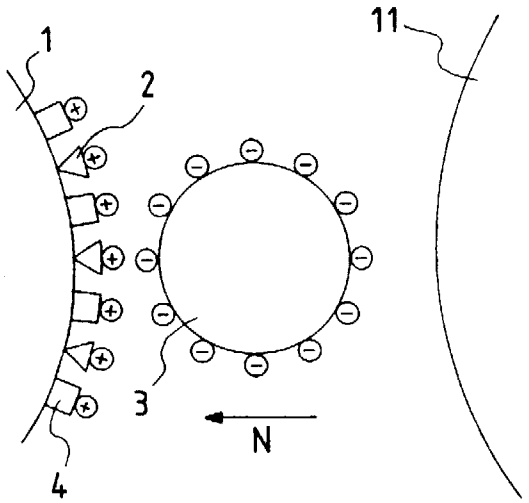
FIG. 1F shows the electrification polarity where an additive is stuck on the surface of the toner carrier member using the electrification ranking shown in FIG. 1D.
Figure 1E:
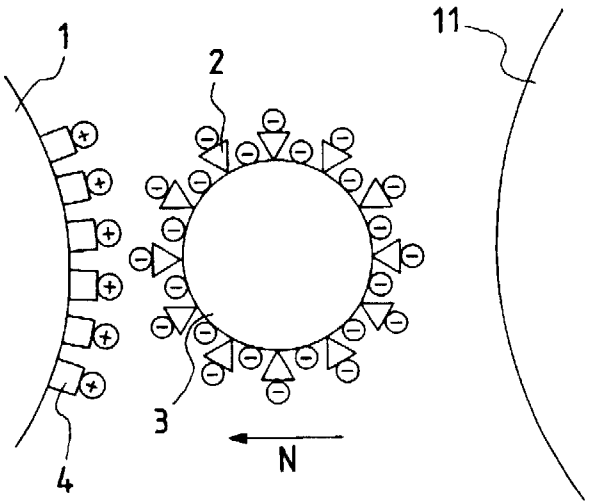
FIG. 1E shows the electrification polarity where an additive is not stuck on the surface of the toner carrier member using the electrification ranking shown in FIG. 1D.
Figure 1D:
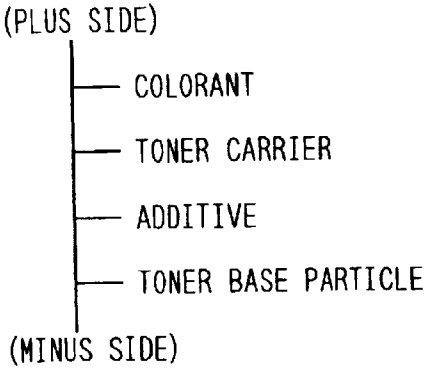
FIG. 1D shows the first relationship among a toner carrier member, an additive and a toner base particle, which further includes a colorant in an electrification rank used for a developing method by negative toner according to the present invention.

FIG. 1D shows the relationship in an electrification rank according to the first embodiment wherein a colorant (i.e., pigment) is included. The case where an additive 2 is less than the toner carrier member 1 in an electrification rank will be described below. FIGS. 1E and 1F show the relationship in relation to the polarity of electrification in the developing unit among the toner carrier member 1, an additive 2, a toner base particle 3 and colorant 4 schematically. As shown in FIG. 1E, if colorant 4 is detached from a toner base particle 3 and is stuck on the surface of the toner carrier member 1, the toner base particle 3 and an additive 2 are in contact with colorant 4 on the surface of the toner carrier member 1, are electrified negatively according to the relationship shown in FIG. 1D, are carried to the image section on the latent image carrier 11 by action of the electric field N and are used to visualize a latent image. Therefore, the toner base particle is not electrified positively (if it is electrified positively, background fog occurs) and is used as normal toner to visualize a latent image on the latent image carrier 11.

As shown in FIG. 1F, if an additive 2 and colorant 4 are stuck on the toner carrier member 1, a toner base particle is contact with colorant 4 and an additive 2 on the surface of the toner carrier member 1, is electrified negatively according to the relationship shown in FIG. 1D, is carried to the image section on the latent image carrier 11 by action of the electric field N and is used to visualize a latent image. Therefore, the toner base particle 3 is not electrified positively (if it is electrified positively, background fog occurs), is used as normal toner to visualize a latent image on the latent image carrier 11 and background fog can be prevented from occurring.

As described above, according to the first embodiment of the present invention, toner can be kept in a desired polarity, toner in reversed polarity can be prevented from occurring and further, background fog can be prevented from occurring by keeping the relationship in a triboelectric series as shown in FIG. 1D even if colorant 4 is detached from a toner base particle 3 and an additive 2, free from toner, is stuck on the toner carrier member 1.

Next, another relationship in an electrification rank according to the first embodiment will be described. As shown in FIG. 1G, the colorant 4 and an additive 2 are less than the toner carrier member 1 in an electrification rank. More particularly, the electrification rank is in the order of the toner carrier member, colorant, an additive and a toner base particle from the positive side. FIG. 1H shows the relationship in the polarity of electrification in the developing unit among the toner carrier member 1, an additive 2, a toner base particle 3 and colorant 4 schematically. As shown in FIG. 1H, if colorant 4 is detached from a toner base particle 3 and is stuck on the surface of the toner carrier member 1, the toner base particle 3 is in contact with colorant 4 on the surface of the toner carrier member 1, is electrified negatively according to the relationship shown in FIG. 1G, is carried to the image section on the latent image carrier 11 by action of the electric field N and is used to visualize a latent image. Further, the relationship in an electrification rank is also applicable to an additive 2 free from toner. When a free additive 2 electrified in the wrong polarity again is stuck on a toner base particle 3, if the free additive 2 is electrified in the polarity opposite to the desired toner polarity, background fog is caused, because the electrification of toner is deteriorated or toner is electrified in reversed polarity. However, in this embodiment, even if relatively many free additives are included and they are readily stuck on a toner base particle 3 again, background fog can be prevented from occurring because a free additive 2 is electrified in the same polarity as the desired toner polarity by the toner carrier member 1. Therefore, in this embodiment, free colorant 4 detached from a toner base particle 3 and an additive 2 free from toner are in contact with the toner carrier member 1, are electrified negatively, are carried to the image section on the latent image carrier 11 by action of the electric field N and are used to visualize a latent image.

Figure 1I:
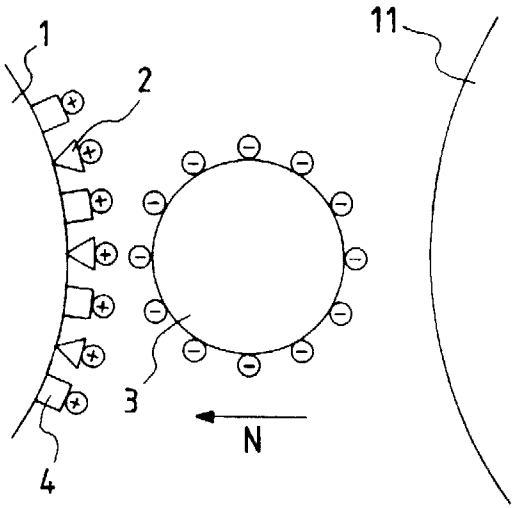
FIG. 1I shows the electrification polarity where an additive is stuck on the surface of a toner carrier member using the electrification ranking shown in FIG. 1G.
Figure 1H:
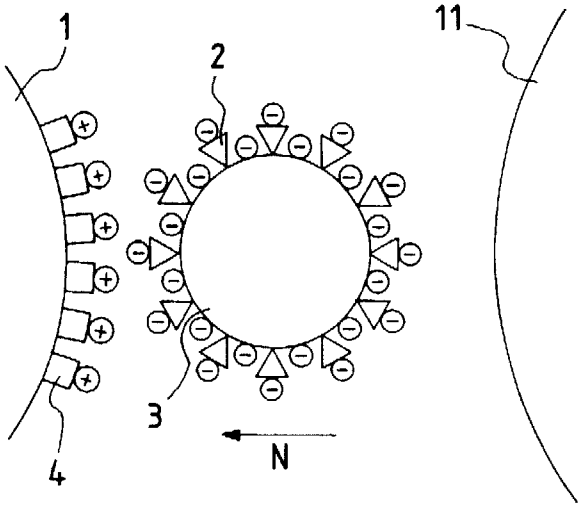
FIG. 1H shows the electrification polarity where an additive is not stuck on the surface of a toner carrier member using the electrification ranking shown in FIG. 1G.
Figure 1G:
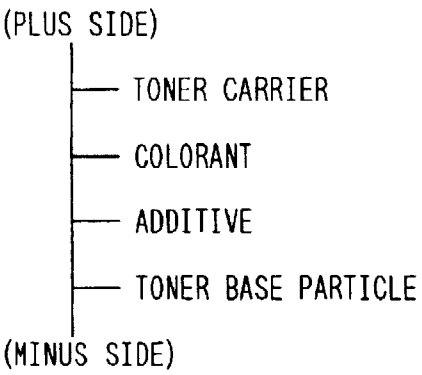
FIG. 1G shows the first relationship among a toner carrier member, an additive and a toner base particle, which further includes a colorant in another electrification rank used for a developing method by negative toner according to the present invention.

As shown in FIG. 1I, if an additive 2 and colorant 4 are stuck on the toner carrier member 1, a toner base particle 3 is in contact with colorant 4 and an additive 2 on the surface of the toner carrier member 1, is electrified negatively according to the relationship shown in FIG. 1G, is carried to the image section on the latent image carrier 11 by action of the electric field N and is used to visualize a latent image. Therefore, the toner base particle 3 is not electrified positively (if it is electrified positively, background fog occurs), is used as normal toner to visualize a latent image on the latent image carrier 11 and background fog can be prevented from occurring.

As described above, if both of colorant 4 detached from a toner base particle 3 and an additive 2 free from toner are stuck on the toner carrier member 1 or even if free colorant and a free additive exist, toner can be kept in desired polarity, toner in reversed polarity can be prevented from occurring and further, background fog can be prevented from occurring by keeping the relationship in a triboelectric series as shown in FIG. 1G.

Figure 1K:
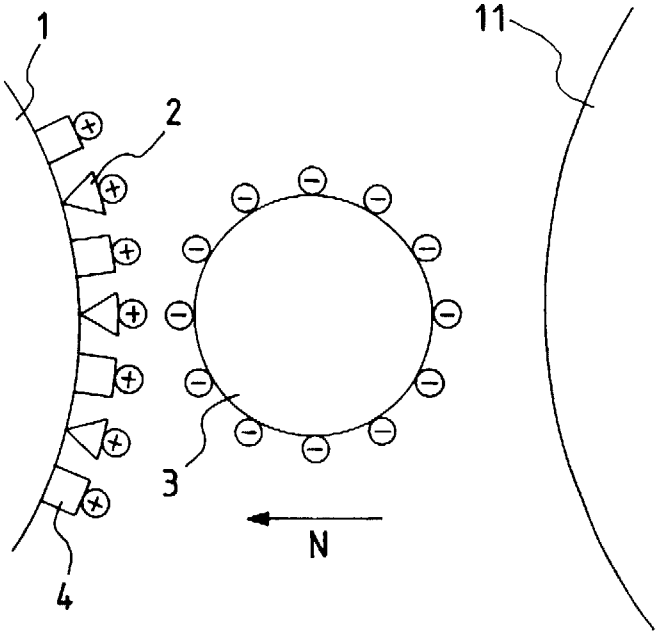
FIG. 1K shows the electrification polarity where an additive is stuck on the surface of a toner carrier member using the electrification ranking shown in FIG. 1J.
Figure 1J:
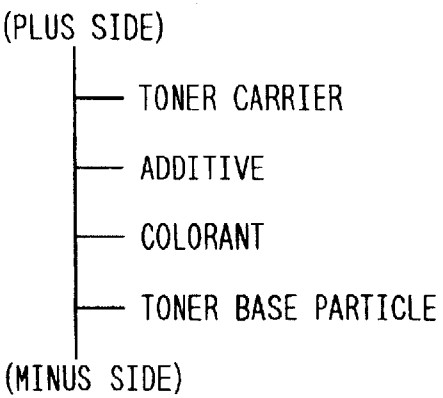
FIG. 1J shows the first relationship among a toner carrier member, an additive and a toner base particle, which further includes a colorant in another electrification rank used for a developing method by negative toner according to the present invention.

Next, another relationship in an electrification rank according to the first embodiment will be described. As shown in FIG. 1J, the colorant 4 is less than an additive 2 in an electrification rank. More particularly, the electrification rank is in the order of the toner carrier member, an additive, colorant and a toner base particle from the positive side. FIG. 1K shows the relationship in relation to the polarity of electrification in the developing unit among the toner carrier member 1, an additive 2, a toner base particle 3 and colorant 4 schematically. As shown in FIG. 1K, if an additive 2 and colorant 4 are stuck on the toner carrier member 1, a toner base particle 3 is in contact with colorant 4 and an additive 2 on the surface of the toner carrier member 1, is electrified negatively according to the relationship shown in FIG. 1J, is carried to the image section on the latent image carrier 11 by action of the electric field N and is used to visualize a latent image. Therefore, the toner base particle is not electrified positively (if it is electrified positively, background fog occurs), is used as normal toner to visualize a latent image on the latent image carrier 11 and further, background fog can be prevented from occurring. Further, according to the relationship in an electrification rank, colorant 4 detached from a toner base particle 3 can be electrified by an additive 2 stuck on the toner carrier member 1. In this embodiment, free colorant 4 detached from a toner base particle 3 and further, a free additive 2 are in contact with the toner carrier member 1, are electrified negatively according to the relationship shown in FIG. 1J, furthermore, free colorant 4 is also electrified negatively by an additive 2 stuck on the toner carrier member 1, is carried to the image section on the latent image carrier 11 by action of the electric field N and is used to visualize a latent image. Therefore, a toner base particle 3, free colorant 4 and further, a free additive 2 are not electrified positively (if they are electrified positively, background fog occurs) and are used as normal toner to visualize a latent image on the latent image carrier 11.

As described above, if detached colorant and a detached additive are stuck on the toner carrier member or even if free colorant and a free additive exist, toner can be kept in desired polarity, toner in reversed polarity can be prevented from occurring by keeping the relationship in an electrification rank as shown in FIG. 1J.

In the following, a second triboelectric series relationship according to the second embodiment of the present invention will be described.

Figure 2C:
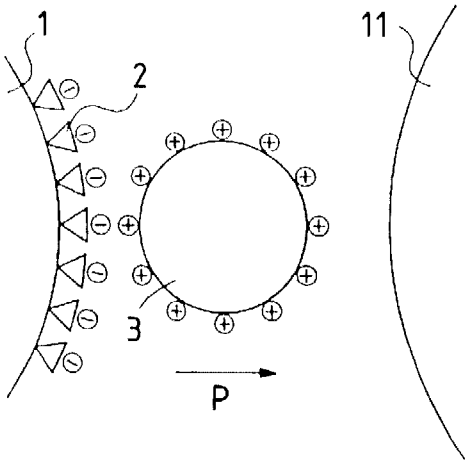
FIG. 2C is a view showing the charge polarity where the surface additives are deposited on a surface of the toner carrier member using the electrification ranking shown in FIG. 1A, for comparison with FIG. 2B.
Figure 2B:
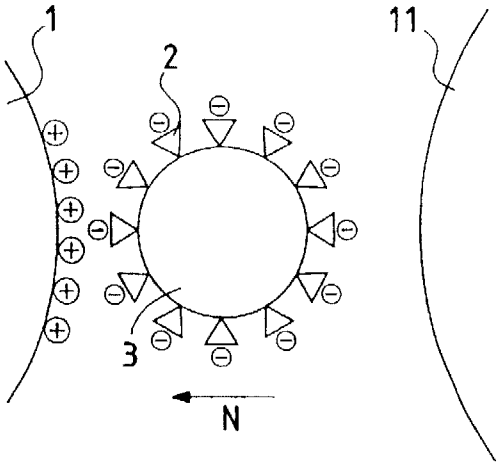
FIG. 2B is a view showing the charge polarity where the surface additives are not deposited on a surface of the toner carrier member using the electrification ranking shown in FIG. 2A.
Figure 2A:
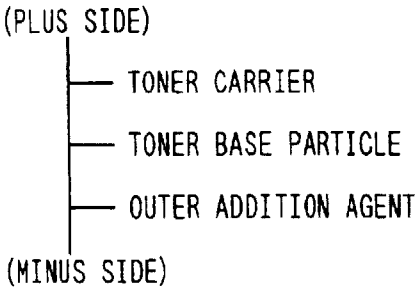
FIG. 2A is a view showing a second relationship between triboelectric series of a toner carrier member, surface additives and a toner base particle used in a developing method using negative toner according to the present invention.

FIG. 2A shows the second triboelectric series relationship. FIG. 2B typically shows the charge polarity relationship between the toner carrier member 1, the surface additives 2 and the toner base particle 3 in a development apparatus. FIG. 2C typically shows a comparative example for explaining FIG. 2B. According to the second embodiment, when the surface additives are not deposited on the toner carrier member 1 as shown in FIG. 2B, the surface additives 2 and the toner base particle 3 being in contact with the toner carrier member 1 are negatively charged on the basis of the relationship in FIG. 2A and moved to the image portion on the latent image carrier 11 by electric field N so that they are used to make the latent image visible. Accordingly, production of positively-charged toner base particles 3 can be prevented, that is, fogging in the ground can be eliminated.

On the other hand, when the surface additives 2 are deposited on the toner carrier member 1 as shown in FIG. 2C, the toner base particle 3 being in contact with the surface additives 2 is positively charged and moved to the non-image portion on the latent image carrier 11 by electric field P in the non-image portion. As a result, fogging in the ground occurs. Accordingly, in the second triboelectric series relationship according to the present invention, it is preferable that the surface additives 2 are not deposited on the toner carrier member 1.

Figure 2E:
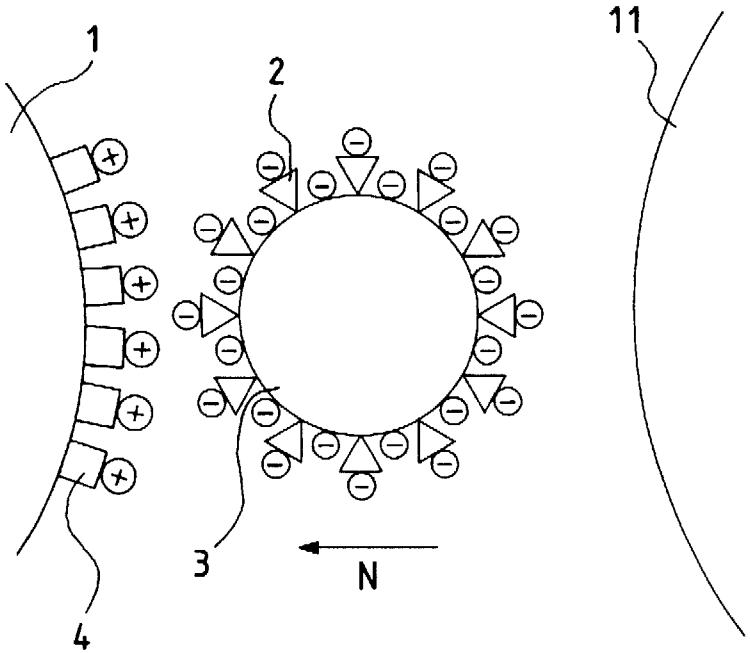
FIG. 2E shows the electrification polarity where an additive is not stuck on the surface of a toner carrier member using the electrification ranking shown in FIG. 2D.
Figure 2D:
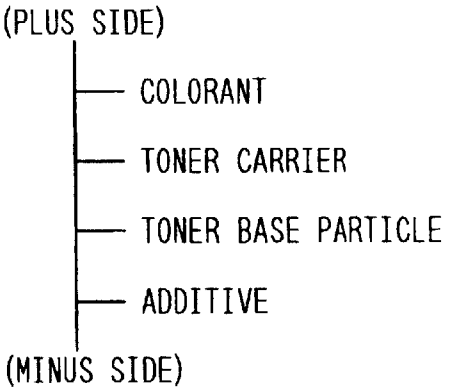
FIG. 2D shows the second relationship among a toner carrier member, an additive and a toner base particle, which further includes a colorant in an electrification rank used for a developing method by negative toner according to the present invention.

FIG. 2D shows the relationship in an electrification rank according to the second embodiment wherein a colorant (i.e., pigment) is included, the colorant being greater than a toner base particle in a triboelectric series. More particularly, FIG. 2D shows the case that the triboelectric series is in the order of colorant, a toner carrier member, a toner base particle and an additive from the positive side. FIG. 2E shows the relationship in relation to the polarity of electrification in a developing unit among a toner carrier member 1, an additive 2, a toner base particle 3 and colorant 4 schematically. As shown in FIG. 2E, if colorant 4 is detached from a toner base particle 3 and is stuck on the surface of the toner carrier member 1, the toner base particle 3 is in contact with colorant 4 on the surface of the toner carrier member 1, is electrified negatively according to the relationship shown in FIG. 2D, is carried to the image section on the latent image carrier 11 by action of the electric field N and is used to visualize a latent image. On the contrary, colorant 4 on the surface of the toner carrier member 1 is electrified positively. Therefore, the toner base particle 3 is not electrified positively (if it is electrified positively, background fog occurs) and is used as normal toner to visualize a latent image on the latent image carrier 11.

As described above, even if colorant is detached from a toner base particle and is stuck on the toner carrier member, toner can be kept in a desired polarity, occurrence of toner in reversed polarity can be prevented and further, background fog can be prevented from occurring.

Figure 2G:
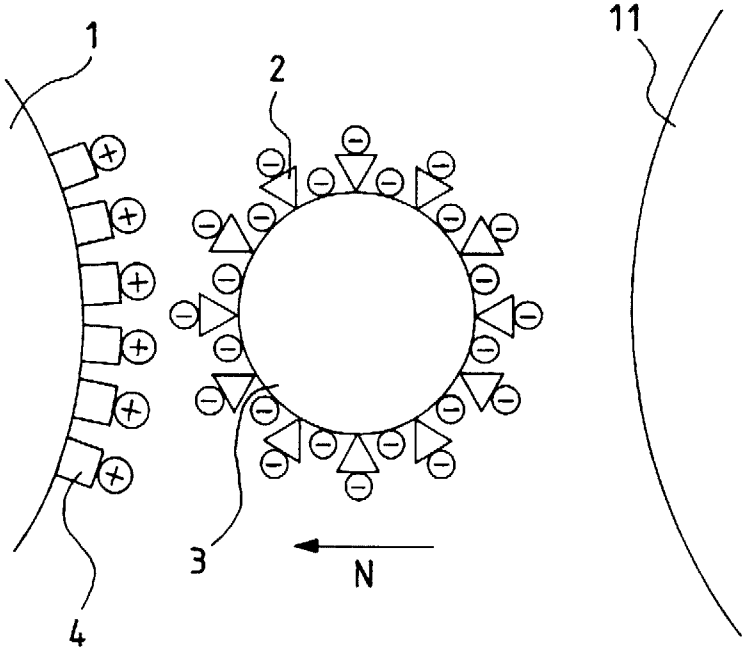
FIG. 2G shows the electrification polarity where an additive is not stuck on the surface of a toner carrier member using the electrification ranking shown in FIG. 2F.
Figure 2F:
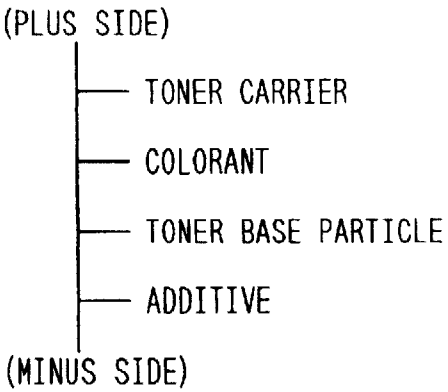
FIG. 2F shows the second relationship among a toner carrier member, an additive and a toner base particle, which further includes a colorant in another electrification rank used for a developing method by negative toner according to the present invention.

Next, another relationship in an electrification rank according to the second embodiment will be described, wherein the colorant is greater than a toner base particle and is less than the toner carrier member in a triboelectric series. More particularly, the case that the triboelectric series is in the order of the toner carrier member, colorant, a toner base particle and an additive from the positive side as shown in FIG. 2F will be described. FIG. 2G shows the relationship in relation to the polarity of electrification in the developing unit among the toner carrier member 1, an additive 2, a toner base particle 3 and colorant 4 schematically. As shown in FIG. 2G, in the case that colorant 4 is detached from a toner base particle 3 and is stuck on the surface of the toner carrier member 1, the toner base particle 3 is contact with colorant 4 on the surface of the toner carrier member 1, is electrified negative according to the relationship shown in FIG. 2F, is carried to the image section on the latent image carrier 11 by action of the electric field N and is used to visualize a latent image. Further, the relationship in the electrification rank is also applicable to free colorant 4 detached from a toner base particle 3. As colorant electrified in wrong polarity causes the defect of an image in case printing is implemented particularly on white paper or in case a full color image is formed by overlapping plural colors of color toners, it is important to remove free colorant so as to obtain a high quality image. In this embodiment, free colorant 4 detached from a toner base particle 3 is in contact with the toner carrier member 1, is electrified negatively, is carried to the image section on the latent image carrier 11 by action of the electric field N and can be used to visualize a latent image. Therefore, the toner base particle 3 and free colorant 4 are not electrified positively (if they are electrified positively, background fog occurs) and are used as normal toner to visualize a latent image on the latent image carrier 11.

As described above, even if colorant is in a more free state, if the colorant is detached from a toner base particle and is stuck on the toner carrier member, toner can be kept in desired polarity, occurrence of toner in reversed polarity can be prevented and further, background fog can be prevented by keeping the relationship in a triboelectric series as shown in FIG. 2F.

In the following, a third triboelectric series relationship according to the present invention will be described. Compared with the aforementioned, first and second triboelectric series relationships, the third triboelectric series relationship is different in that the triboelectric series of the toner base particle 3 is arranged on the plus side with respect to the triboelectric series of the toner carrier member 1. In the relationship, it may be predicted from the second and third triboelectric series relationships that positively-charged toner base particles 3 are produced undesirably. As a result of repeated examination, it has been found, however, that a good characteristic is obtained even in the case of the third triboelectric series relationship.

Figure 3C:
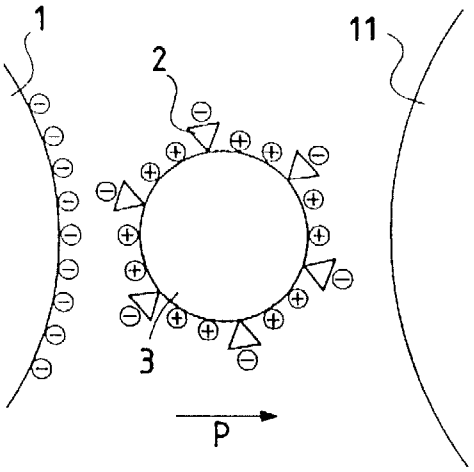
FIG. 3C is a view showing the charge polarity where the covering rate of the surface additives is low, for comparison with FIG. 3B.
Figure 3B:
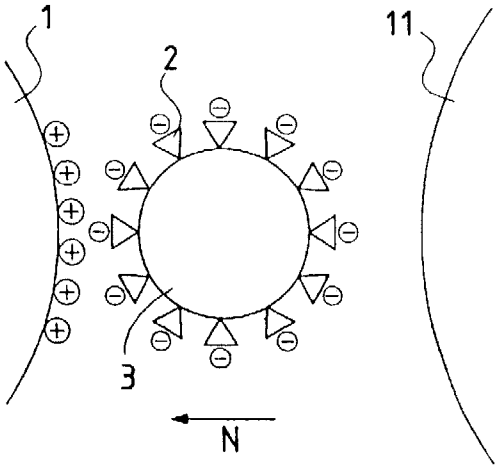
FIG. 3B is a view showing the charge polarity where the surface additives are not deposited on a surface of the toner carrier member, using the electrification ranking shown in FIG. 3A.
Figure 3A:
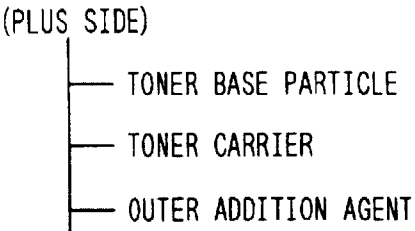
FIG. 3A is a view showing a third relationship between triboelectric series of a toner carrier member, surface additives and a toner base particle used in a developing method using negative toner according to the present invention.

FIG. 3A shows the third triboelectric series relationship according to the third embodiment of the present invention. FIG. 3B typically shows the charge polarity relationship between the toner carrier member 1, the surface additives 2 and the toner base particle 3 in a development apparatus. FIG. 3C typically shows a comparative example with respect to the present invention.

When the surface additives 2 are not deposited on the toner carrier member 1 as shown in FIG. 3B, the surface additives 2 being in contact with the toner carrier member 1 are negatively charged on the basis of the relationship in FIG. 3A and moved to the image portion on the latent image carrier 11 by electric field N so that they are used to make the latent image visible. Accordingly, production of positively-charged toner base particles 3 can be prevented, that is, fogging in the ground can be eliminated.

In the case where the triboelectric series of the toner base particle 3 is arranged on the plus side with respect to the triboelectric series of the toner carrier member 1 as described above, it is necessary that the triboelectric series of the surface additives 2 is arranged on the minus side with respect to the triboelectric series of the toner carrier member 1.

On the other hand, in the case where the rate of covering the surface of the toner base particle 3 with the surface additives 2 is small as shown in FIG. 3C, the toner base particle 3 comes into contact with the toner carrier member 1 easily and is moved as positive toner to the non-image portion on the latent image carrier by electric field P in the non-image portion. As a result, fogging in the ground occurs. From the above description, even in the case where the third triboelectric series relationship according to the present invention is used, that is, in the case where the toner base particle 3 having the triboelectric series arranged on the plus side with respect to the triboelectric series of the toner carrier member 1 are used, the toner base particle 3 can be positively charged to thereby lower fogging when the surface additives 2 arranged on the plus side with respect to the toner carrier member 1 is contained in the surface of the toner base particle 3. By increasing the rate of covering of the surface of the toner carrier member 1 with the surface additives 2, the toner base particle 3 can be further prevented from being positively charged, that is, fogging in the ground can be eliminated preferably.

In the following, the case where toner for making an electrostatic latent image visible is positive toner will be described. "Positive toner" according to the present invention means toner which is such that toner on a toner carrier member is transferred to an area for making an electrostatic latent image on a latent image carrier visible (hereinafter referred to as "image portion") to thereby make the electrostatic latent image visible when the electric field between the image section on the latent image carrier and the toner carrier member is directed from the toner carrier member to the latent image carrier.

A fourth triboelectric series relationship according to the fourth embodiment of the present invention will be described.

Figure 4C:
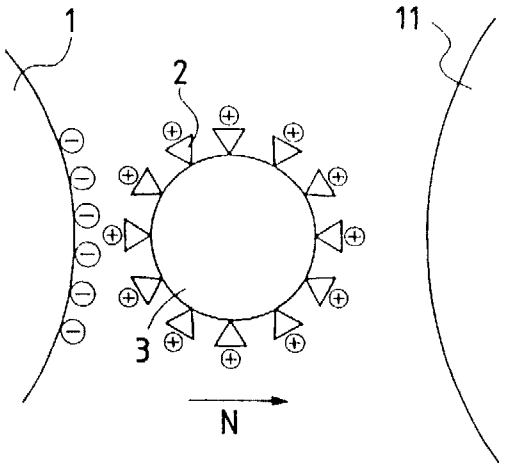
FIG. 4C is a view showing the charge polarity where the surface additives are deposited on a surface of the toner carrier member using the electrification ranking shown in FIG. 4A.
Figure 4B:
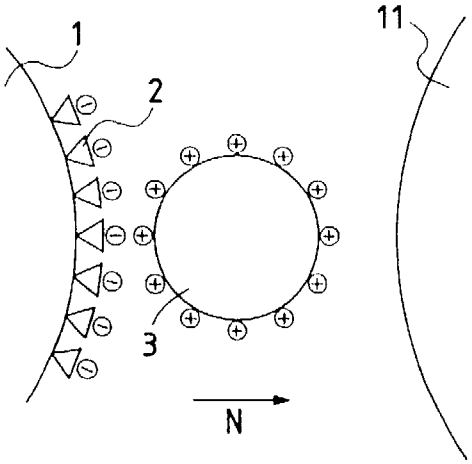
FIG. 4B is a view showing the charge polarity where the surface additives are not deposited on a surface of the toner carrier member using the electrification ranking shown in FIG. 4A.
Figure 4A:
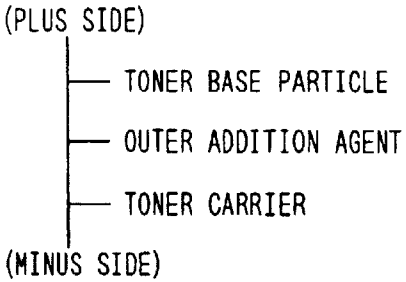
FIG. 4A is a view showing a fourth relationship between triboelectric series of a toner carrier member, surface additives and a toner base particle used in a developing method using positive toner according to the present invention.

FIGS. 4A, 4B and 4C show the case where the first triboelectric series relationship shown in FIGS. 1A, 1B and 1C is applied to positive toner. Specifically, FIG. 4A shows the fourth triboelectric series relationship according to the present invention. FIGS. 4B and 4C typically show the charge polarity relationship between the toner carrier member 1, the surface additives 2 and the toner base particle 3 in a development apparatus.

In the case where the surface additives 2 are departed from the toner base particle 3 and deposed on a surface of the toner carrier member 1 as shown in FIG. 4B, the toner base particle 3 comes into contact with the surface additives 2 on the surface of the toner carrier member 1 and is positively charged on the basis of the relationship in FIG. 4A, so that the toner base particle 3 is moved to the image portion on the latent image carrier 11 by electric field N so as to make the latent image visible. Reversely, the surface additives 2 on the surface of the toner carrier member 1 is negatively charged.

Accordingly, the toner base particle 3 is prevented from being negatively charged as a cause of fogging in the ground, so that it is used for making the latent image on the latent image carrier 11 visible. On the other hand, in the case where the surface additives 2 are not deposited on the toner carrier member 1 as shown in FIG. 4C, the surface additives 2 and the toner base particle 3 being in contact with the toner carrier member 1 are positively charged in connection with FIG. 4A, so that they are used to make the latent image on the latent image carrier 11 visible in the same manner as in FIG. 4B.

As described above, by arranging the respective members so that triboelectric series of the toner carrier member 1, the toner base particle 3 and the surface additives 2 have a relationship of order shown in FIG. 4A, production of negatively-charged toner base particles 3 is prevented regardless of the presence or absence of the surface additives 2 deposited on the surface of the toner carrier member 1. Accordingly, unnecessary toner can be prevented from being deposited on the non-image portion, that is, fogging in the ground can be eliminated.

Figure 4F:
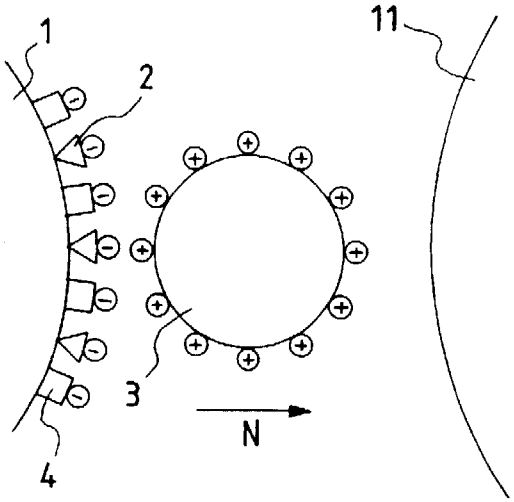
FIG. 4F shows the electrification polarity where an additive is stuck on the surface of the toner carrier member using the electrification ranking shown in FIG. 4D.
Figure 4E:
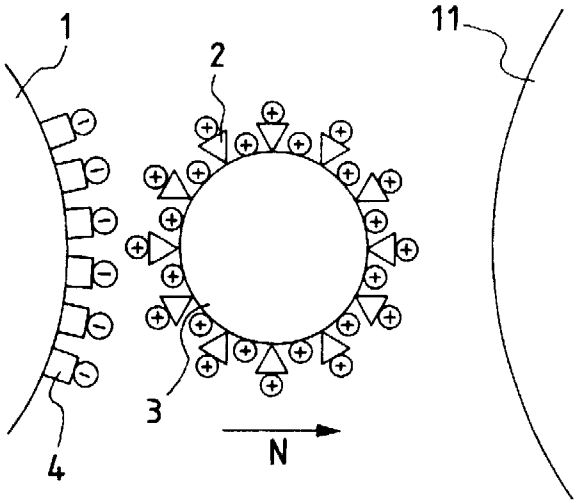
FIG. 4E shows the electrification polarity where an additive is not stuck on the surface of the toner carrier member using the electrification ranking shown in FIG. 4D.
Figure 4D:
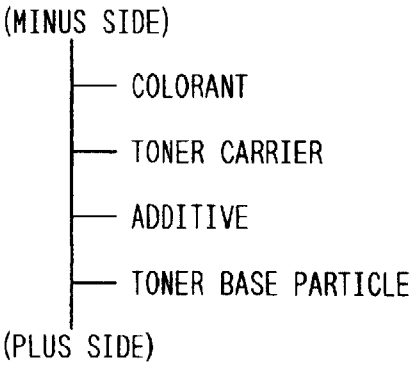
FIG. 4D shows the fourth relationship among a toner carrier member, an additive and a toner base particle, which further includes a colorant in an electrification rank used for a developing method by positive toner according to the present invention.

FIG. 4D shows the relationship in an electrification rank according to the fourth embodiment wherein a colorant is included. The case where additive 2 is closer to the positive side than the toner carrier member I in an electrification rank will be described below. FIGS. 4E and 4F show the relationship in relation to the polarity of electrification in the developing unit among the toner carrier member 1, an additive 2, a toner base particle 3 and colorant 4 schematically. As shown in FIG. 4E, if colorant 4 is detached from a toner base particle 3 and is stuck on the surface of the toner carrier member 1, the toner base particle 3 and an additive 2 are in contact with colorant 4 on the surface of the toner carrier member 1, are electrified positively according to the relationship shown in FIG. 4D, are carried to the image section on the latent image carrier 11 by action of the electric field N and are used to visualize a latent image. Therefore, the toner base particle 3 is not electrified negatively (if it is electrified negatively, background fog occurs) and is used a normal toner to visualize a latent image on the latent image carrier 11.

As shown in FIG. 4F, an additive 2 and colorant 4 are stuck on the toner carrier member 1, a toner base particle 3 is in contact with colorant 4 and an additive 2 on the surface of the toner carrier member 1, is electrified positively according to the relationship shown in FIG. 4D, is carried to the image section on the latent image carrier 11 by action of the electric field N and is used to visualize a latent image. Therefore, the toner base particle 3 is not electrified negatively (if it is electrified negatively, background fog occurs), it is used as normal toner to visualize a latent image on the latent image carrier 11 and background fog can be can be prevented from occurring.

As described above, even if both of colorant 4 detached from a toner base particle 3 and an additive 2 free from toner are stuck on the toner carrier member 1, toner can be kept in a desired polarity, toner in reversed polarity can be prevented from occurring and further, background fog can be prevented from occurring by keeping the relationship in a triboelectric series as shown in FIG. 4D.

Next, another relationship in an electrification rank according to the fourth embodiment will be described. As shown in FIG. 4G, the colorant 4 and an additive 2 are closer to the positive side than the toner carrier member 1 in an electrification rank as shown in FIG. 4G. More particularly, the relationship in an electrification rank is in the order of the toner carrier member, colorant, an additive and a toner base particle from the negative side. FIG. 4H shows the relationship in relation to the polarity of electrification in the developing unit among the toner carrier member 1, an additive 2, a toner base particle 3 and colorant 4 schematically. As shown in FIG. 4H, if colorant 4 is detached from a toner base particle 3 and is stuck on the surface of the toner carrier member 1, the toner base particle 3 is in contact with colorant 4 on the surface of the toner carrier member 1, is electrified positively according to the relationship shown in FIG. 4G, is carried to the image section on the latent image carrier 11 by action of the electric field N and is used to visualize a latent image. Further, the relationship in an electrification rank is also applicable to an additive 2 free from toner. When a free additive 2 electrified in wrong polarity is again stuck on a toner base particle 3, if the free additive 2 is electrified in the polarity opposite to the desired toner polarity, background fog is caused because the electrification of toner is deteriorated or toner is electrified in the opposite polarity. However, in this embodiment, even if relatively many additives are free and they are readily stuck on a toner base particle 3 again, background fog can be prevented from occurring because such a free additive 2 is electrified in the same polarity as desired toner polarity by the toner carrier member 1. Therefore, in this embodiment, free colorant detached from a toner base particle 3 and an additive 2 free from toner are in contact with the toner carrier member 1, are electrified positively, are carried to the image section on the latent image carrier 11 by action of the electric field N and are used to visualize a latent image.

Figure 4I:
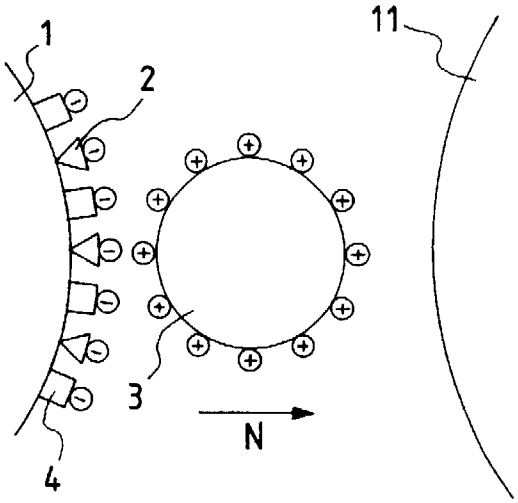
FIG. 4I shows the electrification polarity where an additive is stuck on the surface of a toner carrier member using the electrification ranking shown in FIG. 4G.
Figure 4H:
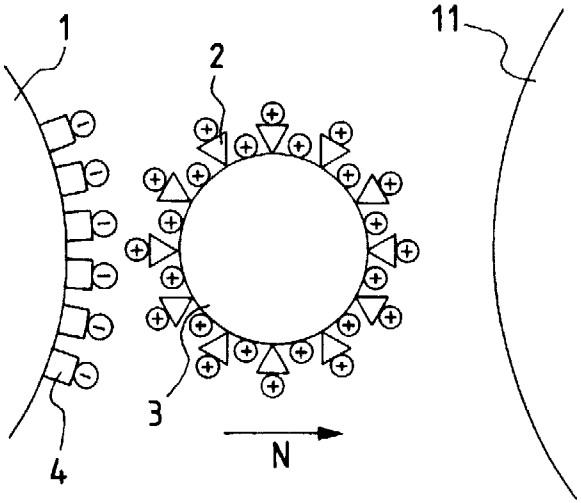
FIG. 4H shows the electrification polarity where an additive is not stuck on the surface of a toner carrier member using the electrification ranking shown in FIG. 4G.
Figure 4G:
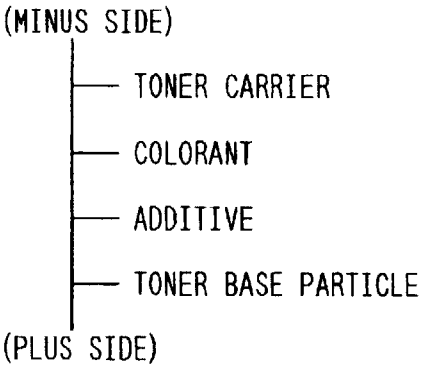
FIG. 4G shows the fourth relationship among a toner carrier member, an additive and a toner base particle, which further includes a colorant in another electrification rank used for a developing method by positive toner according to the present invention.

As shown in FIG. 4I, if an additive 2 and colorant 4 are stuck on the toner carrier member 1, a toner base particle 3 is in contact with colorant 4 and an additive 2 on the surface of the toner carrier member 1, is electrified positively according to the relationship shown in FIG. 4G, is carried to the image section on the latent image carrier 11 by action of the electric field N and is used to visualize a latent image. Therefore, the toner base particle 3 is not electrified negatively (if it is electrified negatively, background fog occurs), is used as normal toner to visualize a latent image on the latent image carrier 11 and background fog can be prevented from occurring.

As described above, if both of colorant 4 detached from a toner base particle 3 and an additive 2 free from toner are stuck on the toner carrier member 1 or even if free colorant and a free additive exist, toner can be kept in desired polarity, toner in reversed polarity can be prevented from occurring and further, background fog can be prevented from occurring by keeping the relationship in a triboelectric series as shown in FIG. 4G.

Figure 4K:
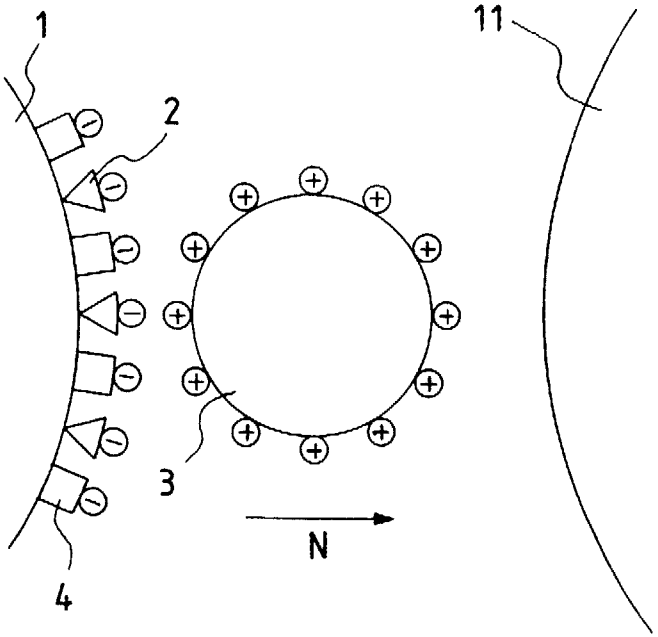
FIG. 4K shows the electrification polarity where an additive is stuck on the surface of a toner carrier member using the electrification ranking shown in FIG. 4J.
Figure 4J:
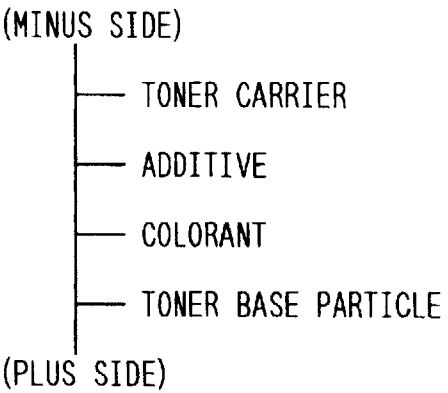
FIG. 4J shows the fourth relationship among a toner carrier member, an additive and a toner base particle, which further includes a colorant in another electrification rank used for a developing method by positive toner according to the present invention.

Next, another relationship in an electrification rank according to the fourth embodiment will be described. As shown in FIG. 4J, the colorant 4 is closer to the positive side than an additive 2 in an electrification rank as shown in FIG. 4J. More particularly, the relationship in an electrification rank is in the order of the toner carrier member, an additive, colorant and a toner base particle from the negative side. FIG. 4K shows the relationship in relation to the polarity of electrification in the developing unit among the toner carrier member 1, an additive 2, a toner base particle 3 and colorant 4 schematically. As shown in FIG. 4K, if an additive 2 and colorant 4 are stuck on the toner carrier member 1, a toner base particle 3 is in contact with colorant 4 and an additive 2 on the surface of the toner carrier member 1, is electrified positively according to the relationship shown in FIG. 4J, is carried to the image section on the latent image carrier 11 by action of the electric field N and is used to visualize a latent image. Therefore, the toner base particle 3 is not electrified negatively (if it is electrified negatively, background fog occurs), is used as normal toner to visualize a latent image on the latent image carrier 11 and background fog can be prevented from occurring. Further, according to the relationship in an electrification rank, colorant 4 detached from a toner base particle 3 can be also electrified by an additive 2 stuck on the toner carrier member 1. In detail, free colorant 4 detached from a toner base particle 3 and an additive 2 further free are in contact with the toner carrier member 1, are electrified positively according to the relationship shown in FIG. 4J, further free colorant 4 is also electrified positively by an additive 2 stuck on the toner carrier member 1, they are carried to the image section on the latent image carrier 11 by action of the electric field N and are used to visualize a latent image. Therefore, the toner base particle 3, the free colorant 4 and further the free additive 2 are not electrified negatively (if they are electrified negatively, background fog occurs) and are used as normal toner to visualize a latent image on the latent image carrier 11.

As described above, if detached colorant and a detached additive are stuck on the toner carrier member or even if free colorant and a free additive exist, toner can be kept in desired polarity, toner in reversed polarity can be prevented from occurring and further, background fog can be prevented from occurring by keeping the relationship in a triboelectric series as shown in FIG. 4K.

In the following, a fifth triboelectric series relationship according to the fifth embodiment of the present invention will be described.

Figure 5C:
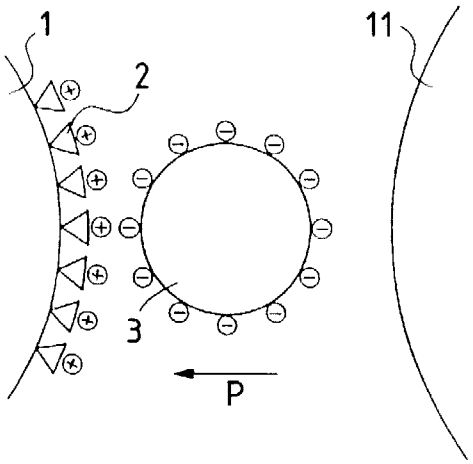
FIG. 5C is a view showing the charge polarity where the surface additives are deposited on a surface of the toner carrier member using the electrification ranking shown in FIG. 5A, for comparison with FIG. 5B.
Figure 5B:
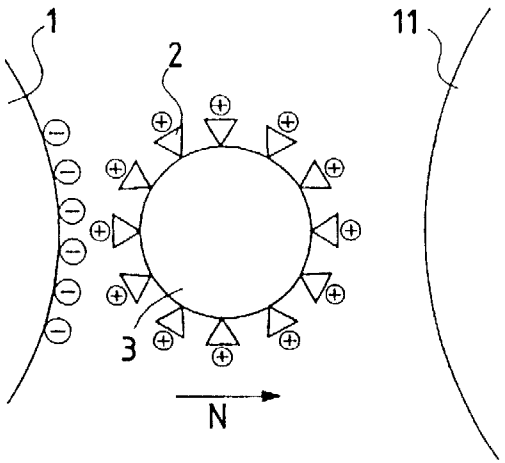
FIG. 5B is a view showing the charge polarity where the surface additives are not deposited on a surface of the toner carrier member using the electrification ranking shown in FIG. 5A.
Figure 5A:
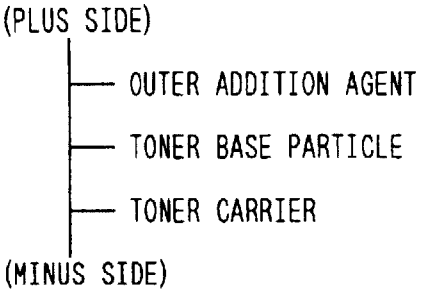
FIG. 5A is a view showing a fifth relationship between triboelectric series of a toner carrier member, surface additives and a toner base particle used in developing method using positive toner according to the present invention.

FIGS. 5A, 5B and 5C show the case where the second triboelectric series relationship shown in FIGS. 2A, 2B and 2C is applied to positive toner. Specifically, FIG. 5A shows the fifth triboelectric series relationship. FIG. 5B typically shows the charge polarity relationship between the toner carrier member 1, the surface additives 2 and the toner base particle 3 in a development apparatus. FIG. 5C typically shows a comparative example for explaining FIG. 5B.

According to the fifth embodiment, when the surface additives 2 are not deposited on the toner carrier member 1 as shown in FIG. 5B, the surface additives 2 and the toner base particle 3 being in contact with the toner carrier member 1 are positively charged on the basis of the relationship in FIG. 5A and moved to the image portion on the latent image carrier 11 by electric field N so that they are used in order to make the latent image visible. Accordingly, production of negatively-charged toner base particles 3 can be prevented, that is, fogging in the ground can be eliminated.

On the other hand, when the surface additives 2 are deposited on the toner carrier member 1 as shown in FIG. 5C, the toner base particle 3 being in contact with the surface additives 2 is negatively charged and moved to the non-image portion on the latent image carrier 11 by electric field P in the non-image portion. As a result, fogging in the ground occurs. Accordingly, in the fifth triboelectric series relationship according to the present invention, it is preferable that the surface additives 2 is not deposited on the toner carrier member 1.

Figure 5E:
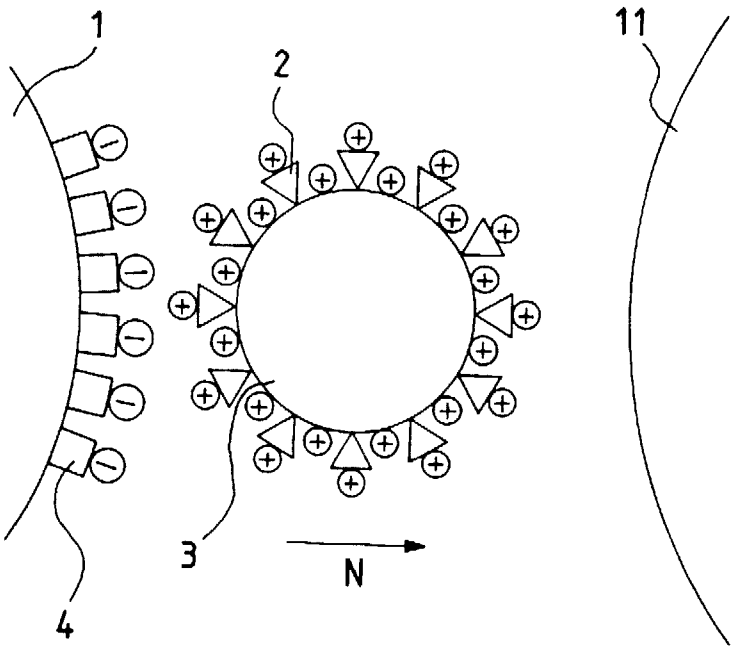
FIG. 5E shows the electrification polarity where an additive is not stuck on the surface of a toner carrier member using the electrification ranking shown in FIG. 5D.
Figure 5D:
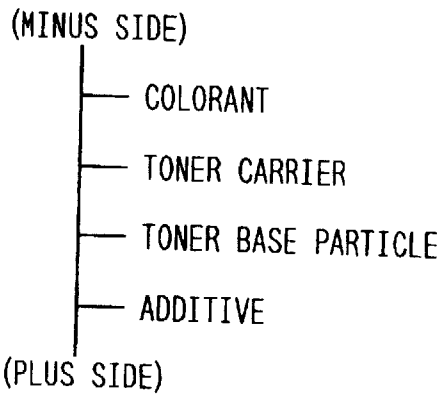
FIG. 5D shows the fifth relationship among a toner carrier member, an additive and a toner base particle, which further includes a colorant in an electrification rank used for a developing method by positive toner according to the present invention.

FIG. 5D shows the relationship in an electrification rank according to the fifth embodiment wherein a colorant (i.e., pigment) is included, the colorant being closer to the negative side than a toner base particle in a triboelectric series. More particularly, the triboelectric series is in the order of colorant, the toner carrier member, a toner base particle and an additive from the negative side. FIG. 5E shows the relationship in relation to the polarity of electrification in the developing unit among the toner carrier member 1, an additive 2, a toner base particle 3 and colorant 4 schematically. As shown in FIG. 5E, if colorant 4 is detached from a toner base particle 3 and is stuck on the surface of the toner carrier member 1, a toner base particle 3 is in contact with colorant 4 on the surface of the toner carrier member 1, is electrified positively according to the relationship shown in FIG. 5D, is carried to the image section on the latent image section on the latent image carrier 11 by action of the electric field N and is used to visualize a latent image. On the contrary, colorant 4 on the surface of the toner carrier member 1 is electrified negatively. Therefore, a toner base particle 3 is not electrified negatively (if it is electrified negatively, background fog occurs) and is used as normal toner to visualize a latent image on the latent image carrier 11.

As described above, even if colorant is detached from a toner base particle and is stuck on the toner carrier member, toner can be kept in a desired polarity, toner in reversed polarity can be prevented from occurring and further, background fog can be prevented from occurring by keeping the relationship in a triboelectric series as shown in FIG. 5D.

Figure 5G:
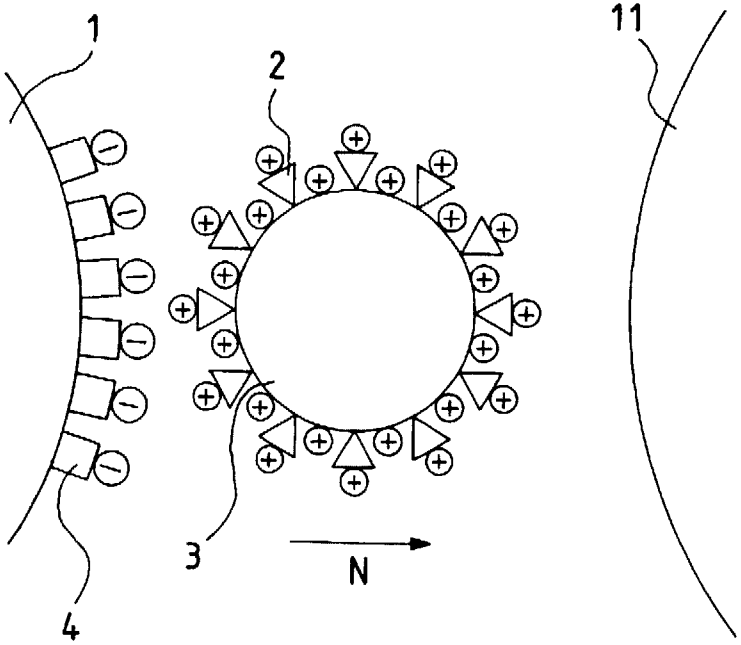
FIG. 5G shows the electrification polarity where an additive is not stuck on the surface of a toner carrier member using the electrification ranking shown in FIG. 5F.
Figure 5F:
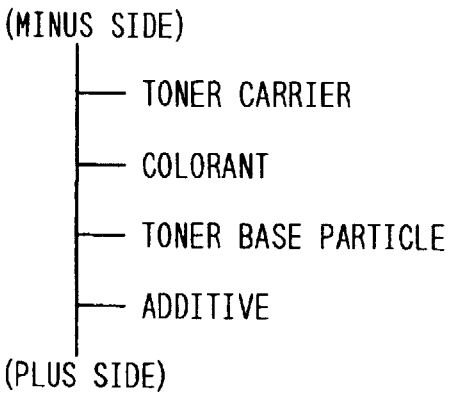
FIG. 5F shows the fifth relationship among a toner carrier member, an additive and a toner base particle, which further includes a colorant in another electrification rank used for a developing method by positive toner according to the present invention.

Next, another relationship in an electrification rank according to the fifth embodiment will be described, wherein the colorant is closer to the negative side than a toner base particle in a triboelectric series and that the toner base particle is closer to the positive side than the toner carrier member. More particularly, as shown in FIG. 5F, the triboelectric series is in the order of the toner carrier member, colorant, a toner base particle and an additive from the negative side. FIG. 5G shows the relationship in relation to the polarity of electrification in the developing unit among the toner carrier member 1, an additive 2, a toner base particle 3 and colorant 4 schematically. As shown in FIG. 5G, if colorant 4 is detached from a toner base particle 3 and is stuck on the surface of the toner carrier member 1, the toner base particle 3 is in contact with colorant 4 on the surface of the toner carrier member 1, is electrified positively according to the relationship shown in FIG. 5F, is carried to the image section of the latent image carrier 11 by action of the electric field N and is used to visualize a latent image. Further, the relationship in an electrification rank is also applicable to free colorant 4 detached from a toner base particle 3. In detail, free colorant 4 detached from a toner electrified positively, is carried to the image section on the latent image carrier 11 by action of the electric field N and can be used to visualize a latent image. Therefore, a toner base particle 3 and free colorant 4 are not electrified negatively (if they are electrified negatively, background fog occurs and are used as normal toner to visualize a latent image on the latent image carrier 11.

As described above, if colorant is detached from a toner base particle and is stuck on the toner carrier member or even if further, the colorant is free, toner can be kept in desired polarity, toner in reversed polarity can be prevented from occurring and further, background fog can be prevented from occurring by keeping the relationship in a triboelectric series as shown in FIG. 5F.

In the following, a sixth triboelectric series relationship according to the sixth embodiment of the present invention will be described.

Figure 6C:
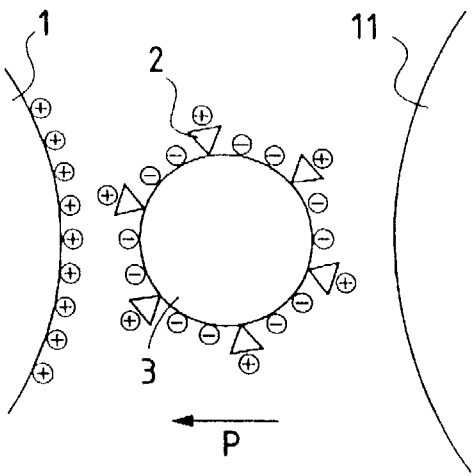
FIG. 6C is a view showing the charge polarity where the covering rate of the surface additives is low, for comparison with FIG. 6B.
Figure 6B:
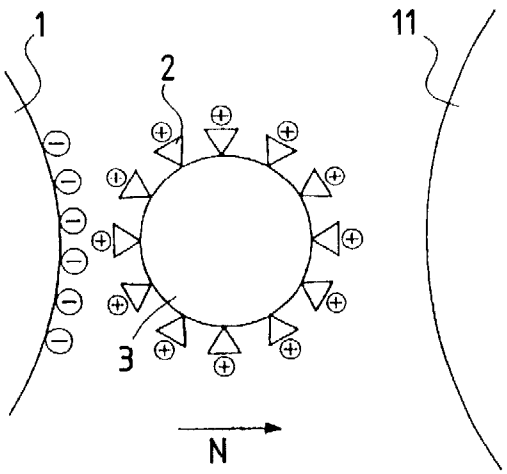
FIG. 6B is a view showing the charge polarity where the surface additives are not deposited on a surface of the toner carrier member using the electrification ranking shown in FIG. 6A.
Figure 6A:
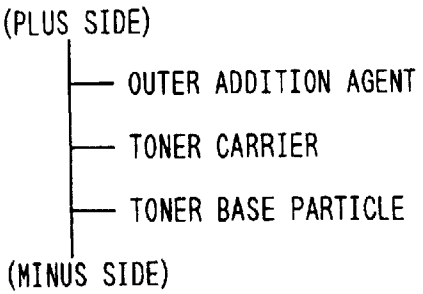
FIG. 6A is a view showing a sixth relationship between triboelectric series of a toner carrier member, surface additives and a toner base particle used in a developing method using positive toner according to the present invention.

FIGS. 6A, 6B and 6C show the case where the third triboelectric series relationship shown in FIGS. 3A, 3B and 3C are applied to positive toner. Compared with the aforementioned, fourth and fifth triboelectric series relationships, the sixth triboelectric series relationships is different in that the triboelectric series of the toner base particle 3 is arranged on the minus side with respect to the triboelectric series of the toner carrier member 1.

In the relationship, it may be predicted from the fourth and fifth triboelectric series relationships that negatively-charged toner base particles 3 are produced undesirably. As a result of repeated examination, it has been found, however, that good characteristic is obtained even in the case of the sixth triboelectric series relationship. Specifically, FIG. 6A shows the sixth triboelectric series relationship according to the sixth embodiment of the present invention. FIG. 6B typically shows the charge polarity relationship between the toner carrier member 1, the surface additives 2 and the toner base particle 3 in a development apparatus. FIG. 6C typically shows a comparative example with respect to the present invention.

When the surface additives 2 are not deposited on the toner carrier member 1 as shown in FIG. 6B, the surface additives 2 being in contact with the toner carrier member 1 are positively charged on the basis of the relationship in FIG. 6A and moved to the image portion of the latent image carrier 11 by electric field N so that they are used to make the latent image visible. Accordingly, production of negatively-charged toner base particles 3 can be prevented, that is, fogging in the ground can be eliminated.

In the case where the triboelectric series of the toner base particle 3 is arranged on the minus side with respect to the triboelectric series of the toner carrier member 1 as described above, it is necessary that the triboelectric series of the surface additives 2 is arranged on the plus side with respect to the triboelectric series of the toner carrier member 1.

On the other hand, in the case where the rate of covering the surface of the toner base particle 3 with the surface additives 2 is small as shown in FIG. 6C, the toner base particle 3 comes into contact with the toner carrier member 1 easily and is moved as negative toner to the non-image portion on the latent image carrier 11 by electric field P in the non-image portion. As a result, fogging in the ground occurs. From the above description, even in the case where the sixth triboelectric series relationship according to the present invention is used, that is, in the case where the toner base particle 3 having the triboelectric series arranged on the minus side with respect to the triboelectric series of the toner carrier member 1 is used, the toner base particle 3 can be prevented from being negatively charged, that is, fogging can be lowered when the surface additives 3 arranged on the plus side with respect to the toner carrier member 1 are contained in the surface of the toner base particle 3. By increasing the rate of covering of the surface of the toner carrier member 1 with the surface additives 2, the toner base particle 3 can be further prevented from being negatively charged, that is, fogging in the ground can be eliminated preferably.

Figure 7:
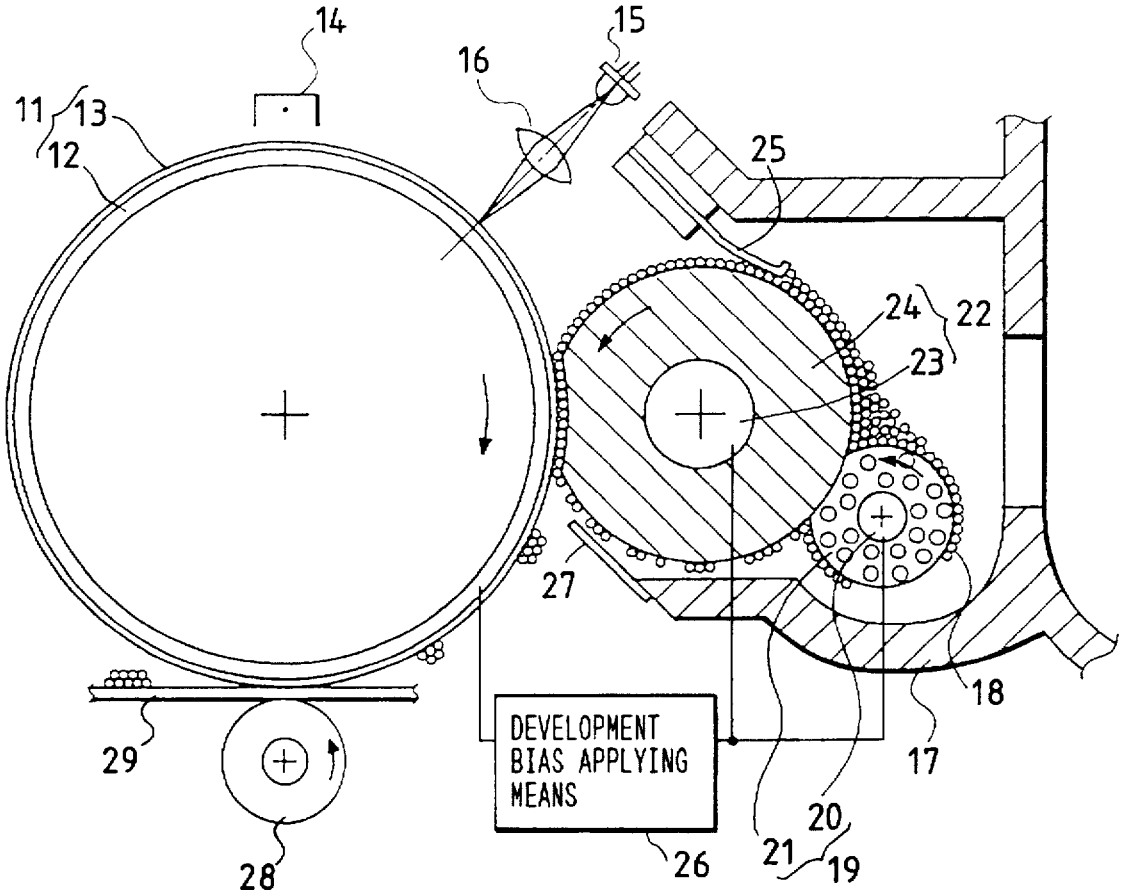
FIG. 7 is a schematic sectional view of an image forming apparatus adopting a developing method according to the embodiments of the present invention.

Next, a schematic sectional view of an image forming apparatus for developing images according to the present invention will be described with reference to FIG. 7. In FIG. 7, an organic or inorganic photosensitive layer 13 having photoconductivity is formed on a conductive supporting portion 12 to thus prepare a latent image carrier 11. With respect to the latent image carrier 11, the photosensitive layer 13 is charged to a predetermined potential by a charger 14 such as a corona charger, a charge roller, etc. After the latent image carrier 11 is charged as described above, light emitted from a light source 15 such as a laser, an LED, etc. is radiated onto the photosensitive layer 13 selectively in accordance with the image through an image-forming optical system 16 such as a scan optical system using a plurality of lenses and a polygon scanner, an equimultiple image-forming system using a fiber array, etc. to thereby obtain potential contrast on the latent image carrier 11 to thus form an electrostatic latent image pattern.

A development apparatus 17 conveys toner 18 to perform development. A supply member 19 for supplying toner 18 has a foam member 21 arranged concentrically on the outer circumference of a shaft 20. A toner carrier member 22 for conveying toner 18 has a conductive elastic material 24 arranged concentrically on the outer circumference of a shaft 23. Toner 18 supplied to the vicinity of the toner carrier member 22 by the supply member 19 is held on the toner carrier member 22. Thin layer regulation is performed by a plate-like regulating member 25 constituted by a nonmagnetic or magnetic metal or resin, so that a suitable amount of toner is obtained. The thin-film toner 18 is conveyed by rotation of the toner carrier member 22 and supplied to a development portion. The toner carrier member 22 is pressed against the latent image carrier 11 by a predetermined amount of pressure. When toner 18 is conveyed to the development portion in which the latent image carrier 11 and the toner carrier member 22 comes into contact with each other, toner 18 charged in accordance with development electric field by the potential contrast of the latent image carrier 11 and a development bias applying means 26 is transferred to the latent image carrier 11 to thereby make the electrostatic latent image pattern visible.

At this time, a development bias is applied to perform reverse development or ordinary development in accordance with the charge polarity of the toner 18. Further, a seal member 27 is disposed in an opening portion of the development apparatus 17. By arranging the seal member 27 so as to slightly touch the toner carrier member 22, toner is prevented from dropping down after development or scattering from the inside of the development apparatus 17.

Further, toner 18 developed on the latent image carrier 11 is transferred to a recording material 29 by applying a voltage to a transfer member 28 such as a transfer roller, a transfer belt, etc. which is suspended to an elastic material such as a spring, etc. so as to be brought into forced contact with the latent image carrier 11 by a light load of the order of several gf/mm. The toner transferred on the recording material 29 is fixed onto the recording member 29 by heat or pressure, so that a desired image is obtained. After transferring, the latent image carrier 11 rotates so that transfer residual toner or foreign matter deposited on the latent image carrier 11 is removed by a cleaning apparatus not shown and, at the same time, unnecessary electric charges on the latent image carrier 11 are removed by a discharger no shown. Then, charging is performed again, so that images are formed continuously by repetition of the aforementioned process.

Recycling of toner may by performed so that toner collected by cleaning is fed back to the development apparatus 17 again. In the following, examples of experiments using the image forming apparatus shown in FIG. 7 will be described for explaining the present invention in detail.

EXPERIMENTAL EXAMPLE 1

An experimental example with respect to the first triboelectric series relationship according to the present invention, specifically the relationship between triboelectric series shown in FIGS. 1A and 1B, and with respect to the toner carrier member, the surface additives and the toner base particle in the case where the surface additives are deposited on a surface of the toner carrier member will be described. Four kinds of toner carrier members shown in Table 1 were used as the toner carrier member.

TABLE 1

| Toner Carrier | Material |
|---|---|
| A | Urethane Rubber (Single Layer) |
| B | NBR (Single Layer) |
| C | Base Material: EPDM, Surface: Urethane Resin (Two Layers) |
| D | Base Material: EPDM, Surface: Nickel Electro-cast Tube (Two Layers) |

Characteristic of the aforementioned toner carrier members are shown in Table 2.

TABLE 2

| Toner carrier member | Hardness (JIS A) | Resistance (Ω) | Surface Roughness Rz (μm) |
|---|---|---|---|
| A | 45 | $5 \times 10^6$ | 6 |
| B | 50 | $1 \times 10^7$ | 5 |
| C | 48 | $1 \times 10^6$ | 3 |
| D | 55 | $5 \times 10^5$ | 2 |

A toner carrier member having an outer diameter of 20 mm and a length of 230 mm was used as the toner carrier member. Further, resistance was calculated on the basis of a voltage in the case were a current of 1 μA was applied in the condition in which loads of 500 g, that is, load of 1 kg in total, were imposed respectively on opposite ends of a plate electrode after the toner carrier member was put on the plate electrode.

Further, surface roughness was obtained by a scan type laser microscope (made by Laser Tec Corp.). Further, a urethane sponge roller having a mean cell size of 300 μm, a cell density of 4/mm and a resistance of $10^7$ Ωcm was used as the supply member. A metal blade made of stainless steel and having a thickness of 0.2 mm was used as the toner layer (thickness) regulating member.

In the following, toner used in this Experimental Example 1 will be described. Components of the toner are shown as follows.

| | |
|---|---|
| Polyester Resin | 88 wt % |
| Polypropylene Wax | 5 wt % |
| Negatively Electrified Charge Control Agent | 1 wt % |
| Carbon Black | 6 wt % |

Raw materials shown in the aforementioned proportion were used. The raw materials were kneaded by a screw extender and ground roughly. Then, they were ground finely by a jet grinder and classified to thus prepare toner base particles A with the volume mean particle size of 9 μm. Then, toner Aa having surface additives a with the particle size of 0.016 μm contained in a surface of 0.8 wt % toner base particles was prepared by using a Henschel mixer. The condition for mixing by the Henschel mixer was 2000 rpm-10 sec. Dry process silica having a surface treated with diemthylsilicone oil was used as the surface additives a. The hydrophobing rate in the surface additives was not smaller than 60%.

Further, toner resistance was $5\times10^{17}$ Ωcm. Further, triboelectric series of the aforementioned materials were found. The triboelectric series were determined by measurement in which polarity was examined by a surface potentiometer while samples were brought into slight contact with each other and rubbed with each other.

In this occasion, the surface additives and the toner base particle were provided as pellets formed by a pressure pellet former. By using such pellets, the triboelectric series of the respective samples were determined.

Results of the triboelectric series are shown in FIG. 8. It is apparent from FIG. 8 that not only the surface additives a is arranged on the plus side with respect with the toner base particle A but the toner carrier member is arranged on the plus side with respect to the surface additive a in any case of the case of the four kinds of toner carrier members. It is further apparent that a regulating member constituted by a metal blade made of stainless steel and a supply member constituted by urethane sponge are arranged on the plus side with respect to the surface additives a. By arranging the regulating member and the supply member on the plus side with respect to the surface additives and the toner base particle, the surface additives and the toner base particle can be charged to the minus side through contact with the regulating member and the supply member.

Accordingly, production of positively-charged toner caused by the regulating member and the supply member can be prevented. Then, with use of the aforementioned, toner carrier member (A, B, C and D), toner, supply member and toner layer (thickness) regulating member, an image was formed by an image forming apparatus shown in FIG. 7. In this occasion, a latent image carrier for minus charge was used as the latent image carrier and the surface potential thereof was set to be −600 V. The development bias applied between the toner carrier member and the latent image carrier was −250 V.

With respect to the image, an all-white pattern (no printing), an all-black pattern and a test pattern were printed successively to thereby evaluate the image. Particularly the amount of toner deposited on the latent image carrier in the case of all-white printing was measured as the quantity of fogging toner. With respect to the measurement, after fogging toner on the photosensitive material was deposited onto a tape (Scotch Mending Tape 810, made by 3M Corp.), weights before and after the deposition were measured by an electronic balance so that the difference between the weights was made the quantity of fogging toner. Results are shown in Table 3.

TABLE 3

| Toner | Toner carrier member | Quantity of Fogging Toner on Latent Image Carrier |
|---|---|---|
| Aa | A | 0.005 mg/cm$^2$ |
| Aa | B | 0.004 mg/cm$^2$ |
| Aa | C | 0.007 mg/cm$^2$ |
| Aa | D | 0.002 mg/cm$^2$ |

As described above, the quantity of fogging toner on the latent image carrier was not larger than 0.01 mg/cm$^2$. Further, recording materials subjected to all-white printing and test-pattern printing were observed by an optical microscope. As a result, a high-quality image almost free from fogging could be formed.

Further, even in the case where running printing up to 10,000 sheets was carried out, a good image free from fogging could be formed so that the image on the last sheet was equal to the image on the first sheet. Further, the same test as described above was carried out under the condition of a high temperature of 35° C. and a high humidity of 65% and under the condition of a low temperature of 10° C. and a low humidity of 15%, respectively. As a result, a good image could be formed stably so as to be free from remarkable deterioration of image quality.

After running printing up to 10,000 sheets, the surface of the toner carrier member was observed by eyes and by a microscope. As a result, the fact that the surface of the toner carrier member was covered with white fine powder was observed in each case of the four kinds of toner carrier members. The white fine powder with which the surface of the toner carrier member was covered was analyzed by an X-ray micro analyzer. As a result, it was found that the white fine powder was silica used. Consequently, it is apparent from the result of Experimental Example 1 that even in the case where the surface additives is deposited on the surface of the toner carrier member, as shown in FIG. 1, a good image free from fogging can be formed as long as triboelectric series have a relationship in which the toner carrier member, the surface additives and the toner base particle are arranged in this order from the plus side.

EXPERIMENTAL EXAMPLE 2

In the following, an experimental example in the case shown in FIG. 1C is shown. A toner carrier member having very low tacking property in its surface, that is, having property in which the surface additives are hard to be deposited, was used as the toner carrier member. The material for the toner carrier member used in this experimental example is shown in Table 4.

TABLE 4

| Toner carrier member | Material |
|---|---|
| E | Base Material:<br>EPDM, Nylon resin (Two Layers) |

Further, characteristic is shown in Table 5.

TABLE 5

| Toner Carrier | Hardness (JIS A) | Resistance (Ω) | Surface Roughness Rz (μm) |
|---|---|---|---|
| E | 45 | $5 \times 10^6$ | 3 |

The same supply member and the same toner layer (thickness) regulating member as used in Experimental Example 1 were used. The same toner base particle A and the same surface additives a as used in Experimental Example 1 were used. Triboelectric series of the respective members used in this experimental example were shown in FIG. 8. Image forming and image evaluation were carried out in the same manner as in Experimental Example 1. As a result, similarly to Experimental Example 1, a good image could be formed. The quantity of fogging toner on the latent image carrier is shown in Table 6.

TABLE 6

| Toner | Toner carrier member | Quantity of Fogging Toner on Latent Image Carrier |
|---|---|---|
| Aa | Toner carrier member E | 0.004 mg/cm$^2$ |

After running test, the surface of the toner carrier member was observed in the same manner as in Experimental Example 1. As a result, there was no observation of deposition of the white surface additives, unlike Experimental Example 1.

As described above, by using the toner carrier member E having property in which the surface additives a is hard to be deposited, a good image free from fogging can be formed as long as the triboelectric series have a relationship of FIG. 1 in which the toner carrier member, the surface additives and the toner base particle are arranged in this order from the plus side as shown in FIG. 1C.

COMPARATIVE EXAMPLE 1

In the following, the case of the triboelectric series relationship shown in FIG. 9 will be described as a comparative example with respect to Experimental Example 1 in which the first triboelectric series relationship has been described. A surface additive b treated with aminosilane was used as the surface additive. The surface additive b was contained in the toner base particle A in the same manner as in Experimental Example 1 to thus prepare toner Ab. Then, image forming was carried out in the same manner as in Experimental Example 1, so that the quantity of fogging toner on the latent image carrier was examined. Results are shown in Table 7.

TABLE 7

| Toner | Toner carrier member | Quantity of Fogging Toner on Latent Image Carrier |
|---|---|---|
| Ab | A | 0.065 mg/cm$^2$ |
| Ab | B | 0.088 mg/cm$^2$ |
| Ab | C | 0.058 mg/cm$^2$ |

It becomes clear from above that when a surface additive having a triboelectric series arranged on the plus side with respect to the triboelectric series of the toner carrier member is used, the quantity of fogging toner increases remarkably so that image quality deteriorates remarkably. This is considered to be based on the fact that the possibility of positively charging toner Ab is increased by contact between the toner Ab and the toner carrier member. That is, in the case where the triboelectric series have a relationship in which the surface additives, the toner carrier member and the toner base particle are arranged in this order from the plus side, fogging increases undesirably.

EXPERIMENTAL EXAMPLE 3

In the following, an experimental example in the second triboelectric series relationship according to the present invention, specifically, the triboelectric series relationship according to the present invention shown in FIGS. 2A and 2B, and with respect to the toner carrier member, the surface additives and the toner base particle in the case where the surface additives are not deposited on the surface of the toner carrier member will be shown. In this experimental example, a toner carrier member E was used.

In this experimental example, a surface additive c having its surface treated with hexamethyldisilazane was used. The surface additive c was contained in the toner base particle A in the same manner as in Experimental Example 1 to thus prepare toner Ac. Triboelectric series of the respective members used in this experimental example are shown in FIG. 10. It is apparent from FIG. 10 that the toner base particle A is positioned on the plus side with respect to the surface additive c. Then, an image was formed in the same manner as in Experimental Example 1. As a result, the good image similar to that in Experimental Example 1 could be formed. The quantity of fogging toner on the latent image carrier is shown in Table 8.

TABLE 8

| Toner | Toner carrier member | Quantity of Fogging Toner on Latent Image Carrier |
|---|---|---|
| Aa | E | 0.005 mg/cm$^2$ |

The surface of the toner carrier member was observed in the same manner as in Experimental Example 1. As a result, there was no observation of deposition of the white surface additives, like Experimental Example 2. It is apparent from above and Experimental Example 2 that the surface additives arranged on the minus side with respect to the toner base particle can be used as long as a toner carrier member having property in which the surface additives are hard to deposit is used. That is, a good image can be formed when the triboelectric series has a relationship in which the toner carrier member, the toner base particle and the surface additives are arranged in this order from the plus side, if the surface additives are not deposited on the toner carrier member.

EXPERIMENTAL EXAMPLE 4

In this experimental example, the surface additive c used in Experimental Example 3 was replaced by a surface additive having its surface treated with dimethyldichlorsilane. The triboelectric series was arranged in the more plus side compared with the surface additive c. Image forming and image evaluation were carried out in the same manner as in Experimental Example 3. As a result, a good image similar to that in Experimental Example 3 could be formed.

COMPARATIVE EXAMPLE 2

In the following, the case of the triboelectric series relationship shown in FIG. 11 will be described as a comparative example with respect to Experimental Example 3 in which the second triboelectric series relationship according to the present invention have been described. By using toner carrier members A, B, C and D as used in Experimental Example 1 and toner Ac constituted by a surface additive c and a toner base particle A as used in experimental Example 3, image forming was carried out in the same manner as in Experimental Example 3. Results are shown in Table 9.

TABLE 9

| Toner | Toner carrier member | Quantity of Fogging Toner on Latent Image Carrier |
|---|---|---|
| Ac | A | 0.030 mg/cm$^2$ |
| Ac | B | 0.025 mg/cm$^2$ |
| Ac | C | 0.037 mg/cm$^2$ |
| Ac | D | 0.020 mg/cm$^2$ |

As shown in this Table, the quantity of fogging toner on the latent image carrier was larger than that in Experimental Example 3, so that a good image could not be formed. The surface of the toner carrier member was observed in the same manner as in Experimental Example 3. As a result, the fact that white fine powder was deposited was observed like Experimental Example 1. As a result of analysis, it was found that the white fine powder was the surface additives used. This is considered to be caused by the fact that the surface additive c is deposited on the surface of the toner carrier member to thereby positively charge the toner base particle A. That is, in the case where the surface additives are deposited on the surface of the toner carrier member, fogging increases undesirably if the triboelectric series have a relationship in which the toner carrier member, the toner base particle and the surface additives are arranged in this order from the plus side.

EXPERIMENTAL EXAMPLE 5

In the following, an experimental example in the third triboelectric series relationship according to the present invention, specifically, the triboelectric series relationship shown in FIG. 3A, 3B and 3C, and with respect to the influence of the quantity of the surface additives on the surface of the toner base particle will be shown. A toner carrier member shown in Table 10 was used as the toner carrier member.

TABLE 10

| Toner carrier member | Material |
|---|---|
| F | Base Material: Silicon, Surface: Fluorine Resin (Two Layers) |

Further, characteristic is shown in Table 11.

TABLE 11

| Toner Carrier | Hardness (JIS A) | Resistance (Ω) | Surface Roughness Rz (μm) |
|---|---|---|---|
| F | 45 | $5 \times 10^6$ | 4 |

Further, toner Ac constituted by a surface additive c and a toner base particle A was used. As the other members, the same supply member and the same toner layer (thickness) regulating member as in Experimental Example 1 were used. The triboelectric series of the members used in this experimental example are shown in FIG. 12. It is apparent from the drawing that the toner base particle A in this experimental example has a tendency to be positively charged when it is brought into contact with the toner carrier member F.

Figure 13:
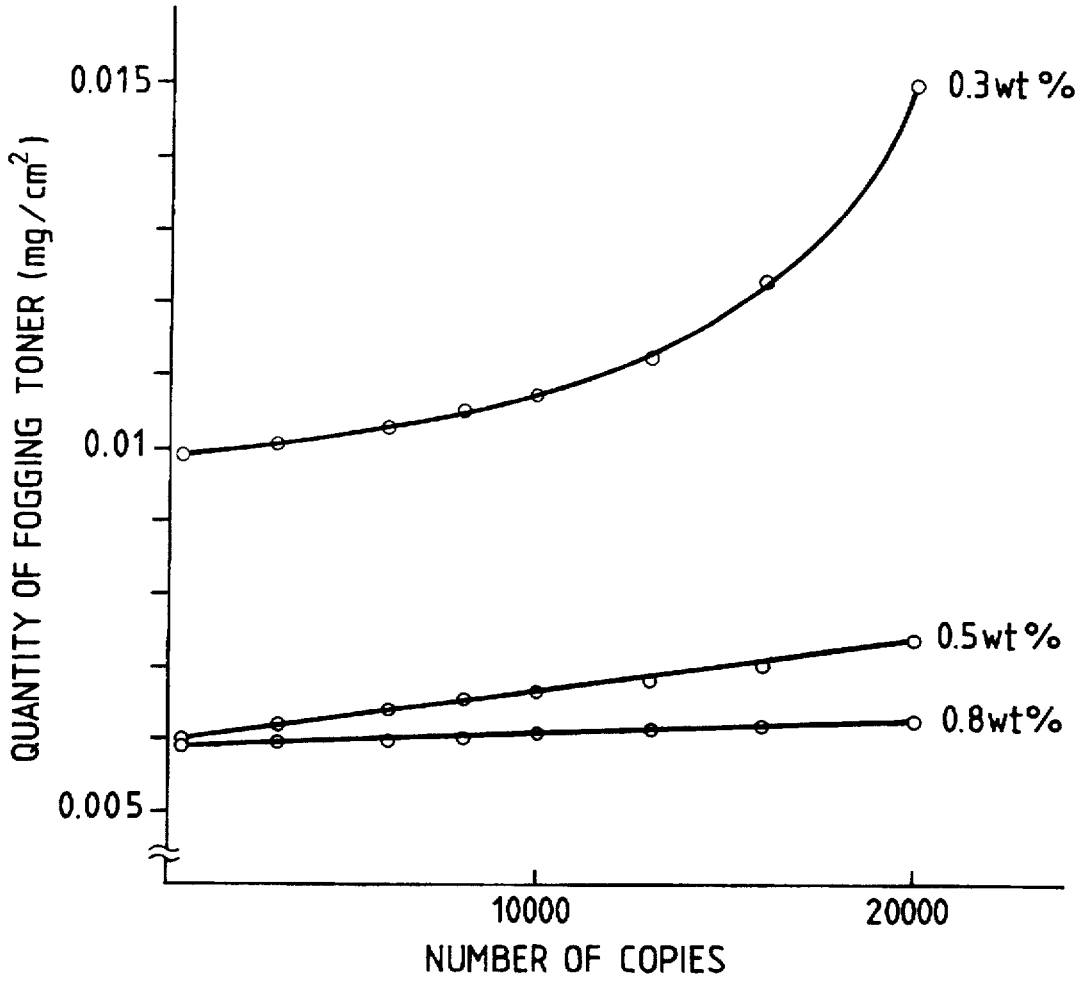
FIG. 13 is a view showing the relation between the number of sheets subjected to printing and the quantity of fogging in Experimental Example 5 according to the present.

Accordingly, it is necessary to increase the surface additive content. In this experimental example, the quantity of the surface additives was changed to 0.3 wt %, 0.5 wt % and 0.8 wt % successively. Results are shown in FIG. 13. It is apparent from FIG. 13 that in the case of the surface additive content of 0.3 wt %, a substantially good image can be formed though more or less fogging occurs in the initial and running stages and increases gradually.

In the case of the surface additive content of 0.5 wt %, a good image can be formed through fogging increases slightly at the time of running. Further, in the case of the surface additive content of 0.8 wt %, a good image can be formed because there is no fogging in the initial and running stages. Further, the surface of the toner carrier member was observed in the same manner as in Experimental Example 1. As a result, there was no deposition of the white surface additives. Accordingly, the surface additive content is preferably not smaller than 0.5 wt %, more preferably, not smaller than 0.8 wt %. It was found that a good image free from fogging could be formed by optimizing the kind of the surface additives (negatively charged with respect to the toner carrier member) and the amount of the surface additives even in the case where a toner base particle having a triboelectric series arranged on the plus side with respect to the triboelectric series of the toner carrier member was used as described above. That is, it is preferable that the triboelectric series have a relationship in which the toner base particle, the toner carrier member and the surface additives are arranged in this order from the plus side.

In the following, experimental examples in the fourth, fifth and sixth triboelectric series relationships using positive toner will be described.

EXPERIMENTAL EXAMPLE 6

In the following, an experimental example in the fourth triboelectric series relationship according to the present invention, specifically, the triboelectric series relationship according to the present invention shown in FIGS. 4A and 4B, and with respect to the toner carrier member, the surface additives and the toner base particle in the case where the surface additives are deposited on the surface of the toner carrier member will be shown. Two kinds of toner carrier members shown in Table 12 were used as the toner carrier member.

TABLE 12

| Toner carrier member | Material |
|---|---|
| G | EPDM (Single Layer) |
| H | Silicon (Single Layer) |

Further, characteristics are shown in Table 13.

TABLE 13

| Toner Carrier | Hardness (JIS A) | Resistance (Ω) | Surface Roughness Rz (μm) |
|---|---|---|---|
| G | 43 | $1 \times 10^6$ | 4 |
| H | 48 | $5 \times 10^5$ | 7 |

Further, the same supply member and the same toner layer (thickness) regulating member as in Experimental Example 1 were used. In the following, toner used in this Experimental Example 5 will be described. Components of the toner are shown as follows:

| | |
|---|---|
| Styrene Acryl Resin | 88 wt % |
| Polypropylene Wax | 5 wt % |
| Positively Electrified Charge Control Agent | 1 wt % |
| Carbon Black | 6 wt % |

By using raw materials shown in the aforementioned proportion, toner base particles B with the volume mean particle size of 9 μm was prepared in the same manner as Experimental Example 1. Next, a surface additive b treated with aminosilane was used as the surface additive so that toner Bb in which a toner base particle B contains the surface additives b was prepared in the same manner as Experimental Example 1. Toner resistance was $5\times10^{17}$ Ωcm.

Further, the triboelectric series of the samples were found in the same manner as in Experimental Example 1. Results of the triboelectric series are shown in FIG. 14. From FIG. 14, the surface additive b is arranged on the minus side with respect to the toner base particle B and the toner carrier member is arranged on the minus side with respect to the surface additives b in each case of the two kinds of toner carrier members. It is further apparent that a regulating member constituted by a metal blade made of stainless steel and a supply member constituted by urethane sponge are arranged on the minus side with respect to the surface additive b.

By arranging the regulating member and the supply member on the minus side with respect to the surface additives and the toner base particle, the surface additives and the toner base particle can be charged to the plus side through contact with the regulating member and the supply member. Accordingly, production of negatively-charged toner caused by the regulating member and the supply member can be prevented. Then, an image was formed by using the aforementioned, toner carrier members (G and H), toner, supply member and toner layer (thickness) regulating member in the same manner as in Experimental Example 1.

In this occasion, a latent image carrier for plus charge was used as the latent image carrier and the surface potential thereof was set to be +600 V. The development bias applied between the toner carrier member and the latent image carrier was +250V. Further, image evaluation was carried out in the same manner as in Experimental Example 1. Results are shown in Table 14.

TABLE 14

| Toner | Toner carrier member | Quantity of Fogging Toner |
|---|---|---|
| Bb | G | 0.005 mg/cm$^2$ |
| Bb | H | 0.004 mg/cm$^2$ |

As described above, the quantity of fogging toner on the latent image carrier was not larger than 0.01 mg/cm$^2$. Further, recording materials subjected to all-white printing and test-pattern printing were observed by an optical microscope. As a result, a high-quality image almost free from fogging could be formed.

Further, even in the case where running printing up to 10,000 sheets was carried out, a good image free from fogging could be formed so that the image on the last sheet was equal to the image on the first sheet. Further, the same test as described above was carried out under the condition of a high temperature of 35° C. and a high humidity of 65% and under the condition of a low temperature of 10° C. and a low humidity of 15%, respectively. As a result, a good image could be formed stably so as to be free from remarkable deterioration of image quality.

After running printing up to 10,000 sheets, the surface of the toner carrier member was observed by eyes and by a microscope. As a result, the fact that the surface of the toner carrier member was covered with white fine powder was observed in each case of the two kinds of toner carrier members. The white fine powder with which the surface of the toner carrier member was covered was analyzed by an X-ray micro analyzer. As a result, it was found that the white fine powder was silica used. Consequently, it is apparent from the result of Experimental Example 6 that even in the case where the surface additives are deposited on the surface of the toner carrier member, a good image free from fogging can be formed as long as triboelectric series have a relationship in which the toner carrier member, the surface additives and the toner base particle are arranged in this order from the minus side as shown in FIG. 4.

EXPERIMENTAL EXAMPLE 7

In the following, an experimental example in the case shown in FIG. 4C is shown. A toner carrier member F used in Experimental Example 5, that is, a toner carrier member having property in which the surface additives are hard to deposit, was used as the toner carrier member.

Further, the same supply member and the same toner layer (thickness) regulating member as in Experimental Example 6 were used. Further, the same toner base particle B and the same surface additive b as in Experimental Example 6 were used. Further, image forming and image evaluation were carried out in the same manner as in Experimental Example 6. As a result, a good image similar to that in Experimental Example 6 could be formed. The quantity of fogging toner on the latent image carrier is shown in Table 15.

TABLE 15

| Toner | Toner carrier member | Quantity of Fogging Toner on Latent Image Carrier |
|---|---|---|
| Bb | F | 0.004 mg/cm$^2$ |

After running test, the surface of the toner carrier member was observed in the same manner as in Experimental Example 6. As a result, there was no observation of deposition of the white surface additives, unlike Experimental Example 6.

As described above, by using the toner carrier member F having property in which the surface additive b is hard to deposit, a good image free from fogging can be formed as long as the triboelectric series of FIG. 4 have a relationship in which the toner carrier member, the surface additives and the toner base particle are arranged in this order from the minus side as shown in FIG. 4C.

COMPARATIVE EXAMPLE 3

In the following, the case of the triboelectric series relationship shown in FIG. 15 will be described as a comparative example with respect to Experimental Example 6 in which the fourth triboelectric series relationship according to the present invention has been described. A surface additive c treated with hexamethyldisilane was used as the surface additive. The surface additive c was contained in the toner base particle B in the same manner as in Experimental Example 6 to thus prepare toner Bc. Then, image forming was carried out in the same manner as in Experimental Example 6, so that the quantity of fogging toner on the latent image carrier was examined. Results are shown in Table 16.

TABLE 16

| Toner | Toner carrier member | Quantity of Fogging Toner on Latent Image Carrier |
|---|---|---|
| Bc | G | 0.075 mg/cm$^2$ |
| Bc | H | 0.081 mg/cm$^2$ |

It becomes clear from above that when a surface additive having a triboelectric series arranged on the minus side with respect to the triboelectric series of the toner carrier member is used, the quantity of fogging toner increases remarkably so that image quality deteriorates remarkably. This is considered to be based on the fact that the probability of negatively charging toner Bc is increased by contact between the toner Bc and the toner carrier member. That is, in the case where triboelectric series have a relationship in which the surface additives, the toner carrier member and the toner base particle are arranged in this order from the minus side, fogging increases undesirably.

EXPERIMENTAL EXAMPLE 8

In the following, an experimental example in the fifth triboelectric series relationship according to the present invention, specifically, the triboelectric series relationship according to the present invention shown in FIG. 5A and 5B, and with respect to the toner carrier member, the surface additives and the toner base particle in the case where the surface additives are not deposited on the surface of the toner carrier member will be shown. In this experimental example, a toner carrier member F was used:

In this experimental example, a surface additive d obtained by surface-treating alumina fine powder with the particle size of 0.013 pm with aminosilane and octylsilane was used. The surface additive d was contained in the toner base particle B in the same manner as in Experimental Example 6 to thus prepare toner Bd. Triboelectric series of the respective members used in this experimental example are shown in FIG. 16. It is apparent from FIG. 16 that the toner base particle B is positioned on the minus side with respect to the surface additive d. Then, an image was formed in the same manner as in Experimental Example 6. As a result, a good image similar to that in Experimental Example could be formed.

The quantity of fogging toner on the latent image carrier is shown in Table 17.

TABLE 17

| Toner | Toner carrier member | Quantity of Fogging Toner on Latent Image Carrier |
|---|---|---|
| Bd | F | 0.003 mg/cm$^2$ |

The surface of the toner carrier member was observed in the same manner as in Experimental Example 6. As a result, there was no observation of deposition of the white surface additives, like Experimental Example 7.

It is apparent from above and Experimental Example 8 that the surface additives arranged on the plus side with respect to the toner base particle can be used as long as a toner carrier member having property in which hard-to-deposit surface additives are used. That is, a good image can be formed when the triboelectric series have a relationship in which the toner carrier member, the toner base particle and the surface additives are arranged in this order from the minus side, if the surface additives are not deposited on the toner carrier member.

EXPERIMENTAL EXAMPLE 9

In this experimental example, the surface additive d used in Experimental Example 8 was replaced by a surface additive obtained by treating titanium oxide fine powder with the mean particle size of 0.021 μm with aminosilane and octylsilane. The triboelectric series of the surface additive was arranged in the more minus side compared with the surface additive d. The other procedure was carried out in the same manner as in Experimental Example 8. As a result, a good image similar to that in Experimental Example 8 could be formed.

COMPARATIVE EXAMPLE 4

In the following, the case of the triboelectric series relationship shown in FIG. 17 will be described as a comparative example with respect to Experimental Example 8 in which the fifth triboelectric series relationship according to the present invention have been described. By using toner carrier member G and H as used in Experimental Example 6 and toner Bd constituted by a surface additive d and a toner base particle B as used in Experimental Example 8, image forming was carried out in the same manner as in Experimental Example 8. Results are shown in Table 18.

TABLE 18

| Toner | Toner carrier member | Quantity of Fogging Toner on Latent Image Carrier |
|---|---|---|
| Bd | G | 0.032 mg/cm$^2$ |
| Bd | H | 0.029 mg/cm$^2$ |

As shown in this Table, the quantity of fogging toner on the latent image carrier was larger than that in Experimental Example 8, so that a good image could not be formed. The surface of the toner carrier member was observed in the same manner as in Experimental Example 8. As a result, the fact that white fine powder was deposited was observed like Experimental Example 6.

As a result of analysis, it was found that the white fine powder was the surface additive used. This is considered to be caused by the fact that the surface additive d is deposited on the surface of the toner carrier member to thereby negatively charge the toner base particle B. That is, in the case where the surface additives are deposited on the surface of the toner carrier member, fogging increases undesirably if the triboelectric series have a relationship in which the toner carrier member, the toner base particle and the surface additives are arranged in this order from the minus side.

EXPERIMENTAL EXAMPLE 10

In the following, an experimental example in the sixth triboelectric series relationship according to the present invention, specifically, the triboelectric series relationship shown in FIGS. 6A, 6B and 6C, and with respect to the influence of the quantity of the surface additives on the surface of the toner base particle will be shown. A toner carrier member E was used as the toner carrier member. Further, toner Bd constituted by a surface additive d and a toner base particle B was used. As the other members, the same supply member and the same toner layer (thickness) regulating member as in Experimental Example 6 were used. The triboelectric series of the members used in this experimental example are shown in FIG. 18.

It is apparent from the drawing that the toner base particle B in this experimental example has a tendency in which it is negatively charged when it is brought into contact with the toner carrier member E. Accordingly, it is necessary to increase the surface additive content. In this experimental example, the quantity of the surface additive was changed to 0.3 wt %, 0.5 wt % and 0.8 wt % successively like Experimental Example 5. Results similar to those in Experimental Example 5 were obtained. Accordingly, the surface additive content is preferably not smaller than 0.5 wt %, more preferably, not smaller than 0.8 wt %. It was found that a good image free from fogging could be formed by optimizing the kind of the surface additives (positively charged with respect to the toner carrier member) and the amount of the surface additive even in the case where a toner base particle having a triboelectric series arranged on the minus side with respect to the triboelectric series of the toner carrier member was used as described above. That is, it is preferable that the triboelectric series having a relationship in which the toner base particle, the toner carrier member and the surface additives are arranged in this order from the minus side.

The following experimental examples include a plurality of additives, in particular, an additive and a colorant.

EXPERIMENTAL EXAMPLE 11

An experimental example of a toner base particle in the case where colorant is stuck on the surface of the toner carrier member in the relationship in an electrification rank disclosed in the second embodiment of the present invention, in the concrete, the relationship in an electrification rank shown in FIGS. 2D and 2E for explaining the present invention will be described below.

Table 19 shows a toner carrier member used in this experiment:

TABLE 19

| Toner carrier member | Material |
|---|---|
| G | EPDM (monolayer) |

Table 20 shows the characteristics of the above-described toner carrier member:

TABLE 20

| Toner carrier member | Hardness (JIS A) | Resistance (Ω) | Roughness of surface Rz (μm) |
|---|---|---|---|
| G | 43 | $1 \times 10^6$ | 4 |

A toner carrier member 20 mm in outer diameter and 230 mm in length is used. The above-described resistance value is calculated based upon the voltage when the toner carrier member is put on a flat electrode and current 1 μA is applied with a load 500 g at both ends and a load of 1 kg in total. The above-described roughness of the surface is provided by a scanning laser microscope manufactured by Laser Tech. For a supply member, a urethane foam roller 300 μm in average diameter of a cell, 4 pieces/mm in cell density and $10^7$ Ωcm in resistance is used and for a layer thickness controlling member, a stainless metal blade 0.2 mm thick is used.

Next, the composition of toner used in the first experiment is as follows:

| | | |
|---|---|---|
| Polyester resin | 88 wt % | toner base particle C |
| Polypropylene wax | 5 wt % | |
| Negative electrified charge control agent | 1 wt % | |
| Colorant a | 6 wt % | |

In this experiment, for colorant a, quinacridon colorant is used. The above-described material is kneaded and ground roughly by a screw extender. Next, it is ground finely by a jet grinder and classified into classes and as a result, a toner base particle C 9 μm in average particle diameter is produced.

Figure 19:
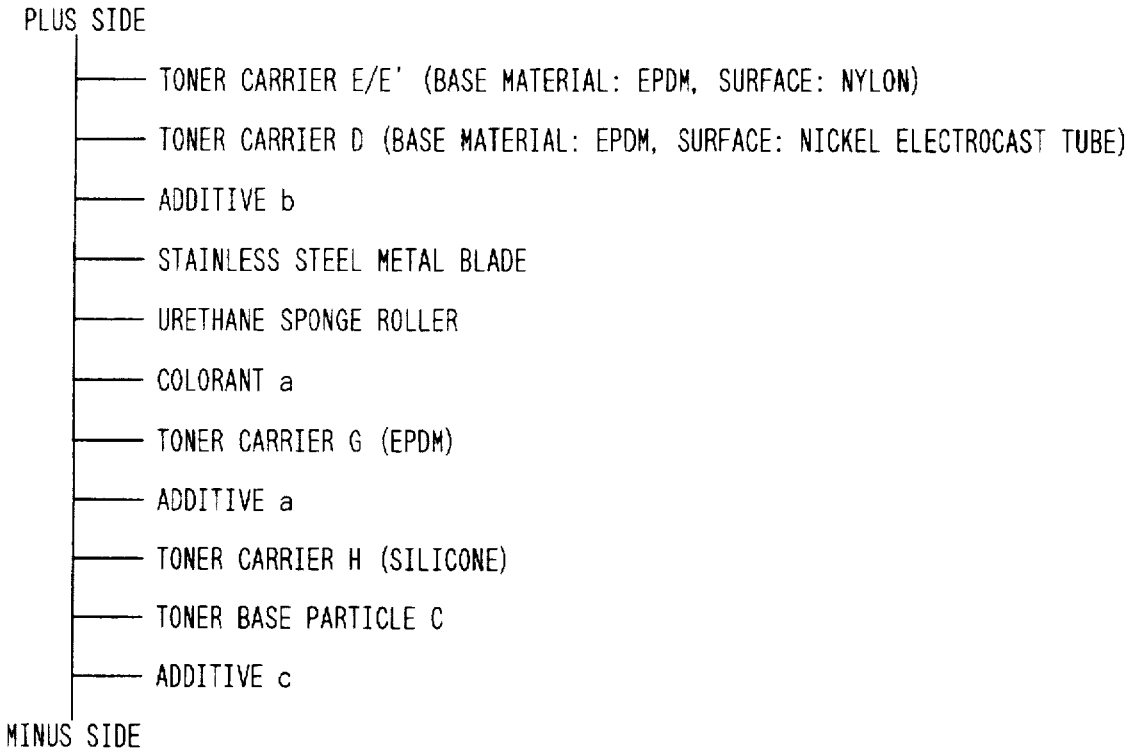
FIG. 19 shows the relationship in an electrification rank among members used for experimental examples of negative toner including colorant according to the present invention.

Next, toner Aac with an additive c 0.016 μm in particle diameter by 0.8 wt % on the surface of the toner base particle is produced using the Henshell mixer. The condition of mixing by Henshell mixer is 2000 rpm/10 sec. The additive c is formed by surface-treating silica manufactured in a dry process with hexamethydisilazane. The ratio of hydrophobe included in the additive is 60% or more. The resistance of toner is $5\times10^{17}$ Ωcm. The electrification rank of the above-described material is determined. The electrification rank is determined by checking the polarity of specimens by a surface potential meter after specimens are touched softly and rubbed. At this time, for an additive, colorant and a toner base particle, their pellets produced by a pressure table machine are used and the electrification rank of their specimens is determined. The result of the electrification rank is shown in FIG. 19. FIG. 19 shows colorant a is closer to the positive side than a toner base particle C. For an electrifying member, a layer thickness controlling member and a toner supply member in addition to a toner carrier member can be also given, however, it is desirable that the polarity of the above-described both members are the same as electrification polarity of toner and in most cases the same as the polarity of the toner carrier member or the above-described electrifying members are inferior to the toner carrier member in a triboelectric series. Therefore, for a control member for which a stainless metal blade is used in this experiment and a supply member for which a urethane foam is used in this experiment, such control and supply members as are closer to the positive side than a toner base particle C and further, are closer to the positive side than the toner carrier member are selected.

As described above, even if colorant is detached from a toner base particle and is stuck on the toner carrier member, toner can be kept in negative polarity, toner in reversed polarity can be prevented from occurring and further, background fog can be prevented from occurring by setting the triboelectric series of colorant closer to the positive side than a toner base particle.

Next, an image is formed by an image formation system shown in FIG. 7 using the above-described toner carrier member (G), toner, supply member and layer thickness controlling member. At this time, a latent image carrier for negative electrification is used and is set so that its surface potential is −600 V. Developing bias −250 V is applied between the toner carrier member and the latent image carrier. A white sheet without printing, a solid sheet and a sheet with a test pattern are printed in order to evaluate their images. Particularly, the amount of toner stuck on the latent image carrier when a white sheet without printing is printed is measured, which is equivalent to the amount of toner causing fog. In detail, toner stuck on the photosensitive member is transferred to a tape, for example Scotch mending tape manufactured by 3M, the weights before and after such toner is stuck on a tape are measured by an electronic balance and the different is equivalent to the amount of toner causing fog. Table 21 shows the result.

TABLE 21

| Toner | Toner carrier member | Amount of toner causing fog on latent image carrier |
|---|---|---|
| Cac | G | 0.005 mg/cm$^2$ |

As described above, the amount of toner causing fog stuck on the latent image carrier is 0.01 mg/cm$^2$ or less. Further, when record mediums without printing and with a test pattern are observed with an optical microscope, little fog is found and high quality images can be formed.

When the surface of the toner carrier member is analyzed qualitatively and observed with an electronic microscope, it is verified that colorant and a toner base particle to the surface of which colorant is exposed are stuck on the toner carrier member. Continuous print of 3,000 sheets is implemented, however, printing is stable till the last sheet and a satisfactory image without fog can be formed as at the initial time. The similar tests are executed under environment at high temperature of 35° C. and high humidity of 65%, and at low temperature of 10° C. and low humidity of 15%, however, no remarkable deterioration of the quality of an image occurs and a satisfactory image can be formed stably. When the surface of the toner carrier member is analyzed qualitatively and observed with an electronic microscope after continuous printing of 3,000 sheets, it is verified that the number of colorant and toner base particles to the surface of which colorant is exposed is a little increased than at the initial time.

The result of the experimental example 11 shows that if colorant is closer to the positive side than a toner base particle in a triboelectric series as shown in FIG. 2D even if colorant is stuck on the surface of the toner carrier member, a satisfactory image without fog can be formed.

EXPERIMENTAL EXAMPLE 12

Next an experimental example of the relationship in an electrification rank according to the second embodiment of the present invention and shown in FIG. 2F will be described.

In this experiment, a toner carrier member shown in Table 22 is used in place of the toner carrier member G used in the Experimental Example 11.

Table 22 shows the characteristics of the toner carrier member used in this experiment.

TABLE 22

| Toner carrier member | Material |
|---|---|
| E | Base material: EPDM<br>Nylon resin (two layers) |
| D | Base material: EPDM<br>Surface: nickel electrocast tube (two layers) |

Table 23 shows another characteristics of the above-described toner carrier member.

TABLE 23

| Toner carrier member | Hardness (JIS A) | Resistance (Ω) | Roughness of surface Rz (μm) |
|---|---|---|---|
| E | 45 | $5 \times 10^6$ | 3 |
| D | 55 | $5 \times 10^5$ | 2 |

The same supply member and layer thickness controlling member as in the Experimental Example 11 are used. The toner base particle C, additive c and colorant a as in the Experimental Example 11 are also used. FIG. 19 shows the electrification rank of the members used in this experimental example. Formation and evaluation of an image, and evaluation of observation are also implemented as in the Experimental Example 11. As a result, a satisfactory image can be formed as in the Experimental Example 11. Table 24 shows the amount of toner causing fog stuck on the latent image carrier.

TABLE 24

| Toner | Toner carrier member | Amount of Toner causing fog on latent image carrier |
|---|---|---|
| Cac | E | 0.001 mg/cm$^2$ |
| Cac | D | 0.003 mg/cm$^2$ |

Continuous printing of 3,000 sheets is implemented, however, printing is stable till the last sheet and a satisfactory image without fog can be formed as at the initial time. The similar tests are executed under environment at high temperature of 35° C. and high humidity of 65%, and at low temperature of 10° C. and low humidity of 15%, however, no remarkable deterioration of the quality of an image occurs and a satisfactory image can be formed stably. After continuous printing of 3,000 sheets, when toner in the vicinity of the surface of the toner carrier member is analyzed qualitatively and observed with an electronic microscope, it is verified that colorant free from toner exists.

The result of the Experimental Example 12 shows that if colorant is detached from a toner base particle and stuck on the toner carrier member or even if further colorant is free, toner can be kept in desired polarity, toner in reversed polarity can be prevented from occurring by keeping the relationship in an electrification rank as shown in FIG. 2F.

EXPERIMENTAL EXAMPLE 13

Next, an experimental example of the relationship in the electrification rank according to the first embodiment of the present invention, in the concrete, of a toner carrier member, an additive and a toner base particle in case an additive is not stuck on the surface of the toner carrier member according to the relationship in an electrification rank shown in FIGS. 1D and 1E will be described.

In this experiment, an additive a formed by surface-treating silica with dimethyl silicone oil is used in place of the additive c used in the Experimental Example 11. Table 25 shows the characteristics of the toner carrier member used in this experiment.

TABLE 25

| Toner carrier member | Material |
|---|---|
| G | EPDM (monolayer) |

Table 26 shows the characteristics of the above-described toner carrier member.

TABLE 26

| Toner carrier member | Hardness (JIS A) | Resistance (Ω) | Roughness of surface Rz (μm) |
|---|---|---|---|
| G | 43 | $1 \times 10^6$ | 4 |

The same supply member and layer thickness controlling member as in the Experimental Example 11 are used. The same toner base particle C and colorant a as in the Experimental Example 11 are also used. The toner carrier member is closer to the positive side than the additive a in an electrification rank as shown in FIG. 19. An image is formed and evaluated according to the same procedure as in the Experimental Example 11. As a result, a satisfactory image can be formed as in the Experimental Example 11.

EXPERIMENTAL EXAMPLE 14

Next, an experimental example of the case shown in FIG. 1F will be described.

In this experiment, the toner carrier member with quick stick on the surface, that is, the toner carrier member which is rough on the surface so that an additive can be readily stuck to the extent that the roughness has no effect on electrification of the toner carrier member is used. Table 27 shows the characteristics of the toner carrier member used in this experimental example.

TABLE 27

| Toner carrier member | Hardness (JIS A) | Resistance (Ωm) | Roughness of surface Rz (μm) |
|---|---|---|---|
| G | 43 | $1 \times 10^6$ | 12 |

The same supply member and layer thickness controlling member as in the Experimental Example 13 are used. The same toner base particle C, additive a and colorant a as in the Experimental Example 13 are also used. FIG. 19 shows the electrification rank of the members used in this experiment. The formation and evaluation of an image and evaluation of observation are also implemented as in the Experimental Example 13. As a result, a satisfactory image can be formed as in the Experimental Example 13.

As described above, even if both of colorant 4 detached from a toner base particle 3 and an additive 2 free from toner are stuck on the toner carrier member 1, toner can be kept in desired polarity, toner in reversed polarity can be prevented from occurring and further, background fog can be prevented from occurring by keeping the relationship in a triboelectric series as shown in FIG. 1D.

EXPERIMENTAL EXAMPLE 15

Next, an experimental example of the relationship in an electrification rank according to the first embodiment of the present invention, in the concrete, of a toner carrier member, an additive and a toner base particle in case an additive is not stuck on the surface of the toner carrier member according to the relationship in an electrification rank shown in FIGS. 1G and 1H according to the present invention will be described.

Table 28 shows the characteristics of the toner carrier member used in this experiment.

TABLE 28

| Toner carrier member | Material |
|---|---|
| E | Base material: EPDM<br>Nylon resin (two layers) |
| D | Base material: EPDM<br>Surface: nickel electrocast tube (two layers) |

Table 29 shows another characteristics of the above-described toner carrier member.

TABLE 29

| Toner carrier member | Hardness (JIS A) | Resistance (Ω) | Roughness of surface Rz (μm) |
|---|---|---|---|
| E | 45 | $5 \times 10^6$ | 3 |
| D | 55 | $5 \times 10^5$ | 2 |

The same supply member and layer thickness controlling member as in the Experimental Example 11 are used. The toner base particle C and colorant a are also used.

In this Experimental Example, an additive a formed by surface-treating silica with dimethyl silicon oil is used. The additive a is closer to the negative side than colorant a in an electrification rank as shown in FIG. 19. As a result of formation and evaluation of an image and evaluation of observation, a satisfactory image can be formed. It is verified that colorant and an additive free from toner are included in toner in the vicinity of the toner carrier member.

EXPERIMENTAL EXAMPLE 16

Next, an experimental example of the case shown in FIG. 1I will be described.

In this experiment, the toner carrier member with quick stick on the surface, that is, the toner carrier member which is rough on the surface to the extent that the roughness has no effect on electrification of the toner carrier member so that an additive can be readily stuck on the toner carrier member is used. Table 30 shows the characteristics of the toner carrier member used in this experiment.

TABLE 30

| Toner carrier member | Hardness (JIS A) | Resistance (Ω) | Roughness of surface Rz (μm) |
|---|---|---|---|
| E' | 45 | $5 \times 10^6$ | 10 |

The same supply member and layer thickness controlling member as the Experimental Example 15 are used. The same toner base particle C, additive a and colorant a as the Experimental Example 15 are also used. FIG. 19 shows the electrification rank of the members used in this experiment. The formation and evaluation of an image and evaluation of observation are also implemented as in the Experimental Example 15. As a result, a satisfactory image can be formed as in the Experimental Example 15.

As described above, if both of colorant 4 detached from a toner base particle 3 and an additive free from toner base particle 3 and an additive free from toner are stuck on the toner carrier member 1 or even if free colorant and a free additive exist, toner can be kept in desired polarity, toner in reversed polarity can be prevented from occurring and further, background fog can be prevented from occurring by keeping the relationship in a triboelectric series as shown in FIG. 1G.

EXPERIMENTAL EXAMPLE 17

Next, another experimental example of the relationship in an electrification rank according to the first embodiment of the present invention, in the concrete, of a toner carrier member, an additive and a toner base particle in case an additive is stuck on the toner carrier member according to the relationship in an electrification rank shown in FIGS. 1J and 1K according to the present invention will be described. In this experiment, an additive b formed by surface-treating with aminosilane is used in place of the additive a used in the Experimental Example 16. The additive is slightly closer to the positive side than colorant a in an electrification rank as shown in FIG. 19. This experimental example is similar to the Experimental Example 16 except the above-described and as a result of formation and evaluation of an image and evaluation of observation, a satisfactory image can be formed as in the Experimental Example 16.

As described above, if detached colorant and a detached additive are stuck on the toner carrier member or even if free colorant and a free additive exist, toner can be kept in desired polarity, toner in reversed polarity can be prevented from occurring and further, background fog can be prevented from occurring by keeping the relationship in a triboelectric series as shown in FIG. 1J.

Next, experimental examples using positive toner which includes a colorant will be described.

EXPERIMENTAL EXAMPLE 18

An experimental example of the relationship in an electrification rank according to the fifth embodiment of the present invention, in the concrete, of a toner base particle in case colorant is stuck on the surface of the toner carrier member according to the relationship in an electrification rank shown in FIGS. 5D and 5E will be described below.

The toner carrier member shown in Table 31 is used.

TABLE 31

| Toner carrier member | Material |
|---|---|
| A | Urethane rubber (monolayer) |
| B | NBR (monolayer) |
| C | Base material: EPDM<br>Surface: Urethane resin (two layers) |

Table 32 shows the characteristics of the above-described toner carrier member.

TABLE 32

| Toner carrier member | Hardness (JIS A) | Resistance (Ω) | Roughness of surface Rz (μm) |
|---|---|---|---|
| A | 45 | $5 \times 10^6$ | 6 |
| B | 50 | $1 \times 10^7$ | 5 |
| C | 48 | $1 \times 10^6$ | 3 |

The same supply member and layer thickness controlling member as in the Experimental Example 11 are used.

Next, toner used in this Experimental Example 18 will be described. The composition of the toner is as follows:

| | | |
|---|---|---|
| Stylene acrylic resin | 88 wt % | toner base particle D |
| Polypropylene wax | 5 wt % | |
| Positive electrified charge control agent | 1 wt % | |
| Colorant b | 6 wt % | |

In this experiment, rhodamine colorant is used for colorant. As in the Experimental Example 11, a toner base particle D 9 pm in average particle diameter per volume is produced using the above-described materials.

Figure 20:
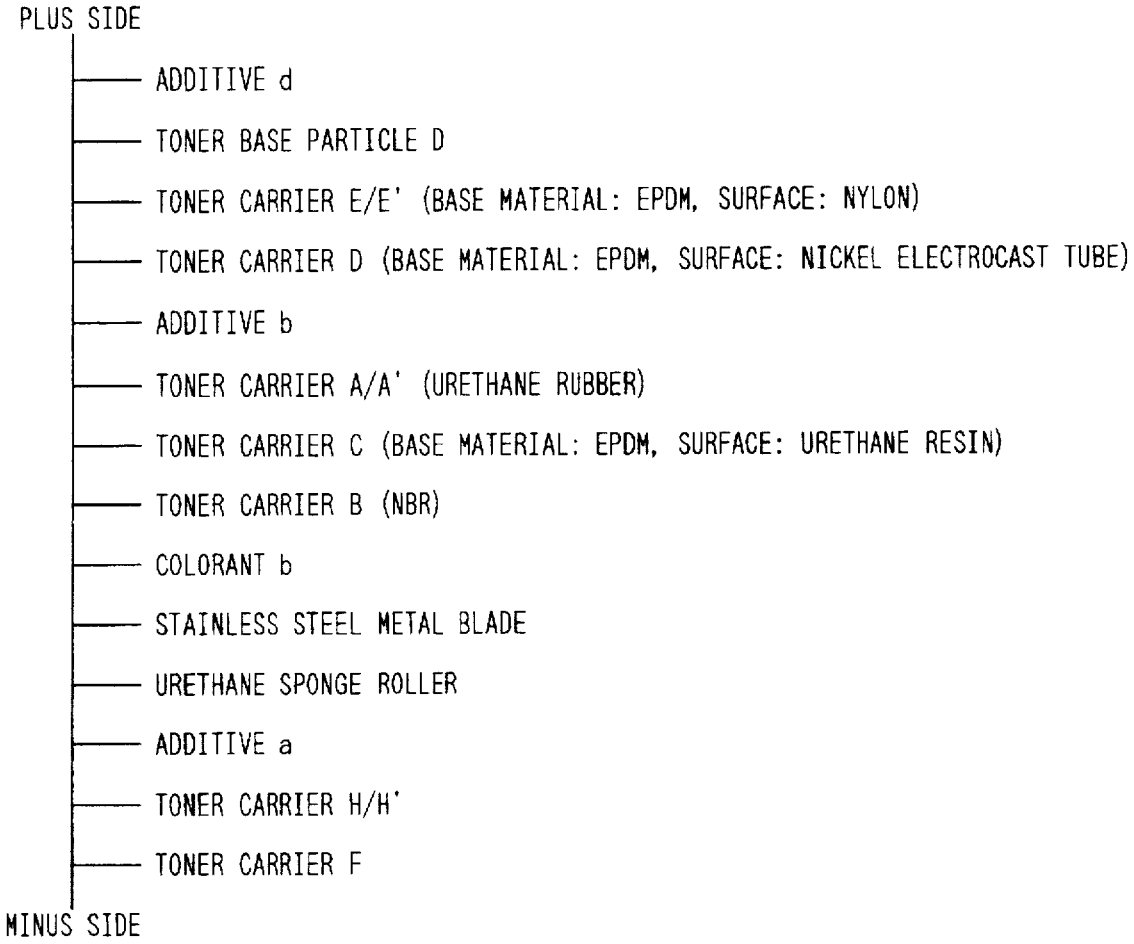
FIG. 20 shows the relationship in an electrification rank among members used for experimental examples of positive toner including colorant according to the present invention.

Next, for an additive, an additive d formed by surface-treating alumina fine particle 0.013 μm in particle diameter with aminosilane and octyl silane is used and as in the Experimental Example 11, toner Dbd is produced by adding the additive d to a toner base particle D. The resistance of the toner is $5\times10^{17}$ Ωcm. As in the Experimental Example 11, the electrification rank of specimens is determined. FIG. 20 shows the result of the electrification rank. FIG. 20 shows colorant b is closer to the negative side than a toner base particle D. For an electrifying member, a layer thickness controlling member and a toner supply member in addition to a toner carrier member can be also given, however, it is desirable that the polarity of these both members is the same as the electrification polarity of toner and that in most cases is the same as that of the toner carrier member or the above-described electrifying member is inferior in a triboelectric series. Therefore, in this experiment, the control member for which a stainless metal blade is used and the supply member for which urethane foam is used which are closer to the negative side than a toner base particle D and further are closer to the negative side than the toner carrier member are selected.

As described above, even if colorant is detached from a toner base particle and stuck on the toner carrier member, toner can be kept in positive polarity, toner in reversed polarity can be prevented from occurring and further, background fog can be prevented from occurring by setting the triboelectric series of colorant so that it is closer to the negative side than a toner base particle.

Next, as in the Experimental Example 11, an image is formed using the above-described toner carrier member (C, D, E), toner, the supply member and the layer thickness controlling member. However, at this time, a latent image carrier for positive electrification is used and the surface potential is set to +600 V. The bias for development applied between the toner carrier member and the latent image carrier is set to +250 V. Evaluation of an image is also implemented as in the Experimental Example 11. Table 33 shows the result.

TABLE 33

| Toner | Toner carrier member | Amount of toner causing fog on latent image carrier |
|---|---|---|
| Dbd | A | 0.003 mg/cm$^2$ |
| Dbd | B | 0.001 mg/cm$^2$ |
| Dbd | C | 0.001 mg/cm$^2$ |

As described above, the amount of toner causing fog stuck on the latent image carrier is 0.01 mg/cm$^2$ or less. Further, when a white sheet without printing though it is printed and a sheet on which a test pattern is printed are observed with an optical microscope, little fog is found and a high quality image can be formed.

When the surface of the toner carrier member is analyzed qualitatively and observed with an electronic microscope, it is verified that colorant itself and a toner base particle to the surface of which colorant is exposed are stuck on the toner carrier member.

Continuous printing of 3000 sheets is implemented, however, printing is stable till the last sheet and a satisfactory image without fog can be formed as at the initial time. The similar tests are implemented under environment at high temperature of 35° C. and high humidity of 65%, and at low temperature of 10° C. and low humidity of 15%, however, no remarkable deterioration of the quality of an image occurs and a satisfactory image can be formed stably. When the surface of the toner carrier member is observed visually and with microscope after continuous printing of 3000 sheets, colorant itself a little more increased than at the initial time and a toner base particle to the surface of which colorant is exposed are found on the surface of the above-described toner carrier member.

As described above, the result of the Experimental Example 18 shows that if colorant is closer to the negative side than a toner base particle in a triboelectric series as shown in FIG. 5D even if colorant is stuck on the surface of the toner carrier member, a satisfactory image without fog can be formed.

EXPERIMENTAL EXAMPLE 19

Next, an experimental example of the relationship in an electrification rank according to the fifth embodiment of the present invention shown in FIG. 5F will be described.

In this experiment, a toner carrier member shown in Table 34 is used in place of the toner carrier member G used in the Experimental Example 18.

Table 34 shows the characteristics of a toner carrier member used in this experiment.

TABLE 34

| Toner carrier member | Material |
|---|---|
| F | Base material: silicone<br>Surface: fluorine contained resin (two layers) |
| H | Silicone (monolayer) |

Table 35 shows another characteristics of the above-described toner carrier member.

TABLE 35

| Toner carrier member | Hardness (JIS A) | Resistance (Ω) | Roughness of surface Rz (μm) |
|---|---|---|---|
| F | 45 | $5\times10^6$ | 4 |
| H | 48 | $5\times10^5$ | 7 |

The same supply member and layer thickness controlling member as in the Experimental Example 18 are used. The toner base particle D, additive d and colorant b as in the Experimental Example 18 are also used. FIG. 20 shows the electrification rank of the members used in this experiment. Formation and evaluation of an image and evaluation of observation are also implemented as in the Experimental Example 18. As a result, a satisfactory image can be formed as in the Experimental Example 18. Table 36 shows the amount of toner causing fog stuck on the latent image carrier.

TABLE 36

| Toner | Toner carrier member | Amount of toner causing fog on latent image carrier |
|---|---|---|
| Dbd | F | 0.001 mg/cm$^2$ |
| Dbd | H | 0.003 mg/cm$^2$ |

Continuous printing of 3000 sheets is implemented, however, printing is stable till the last sheet and a satisfactory image without fog can be formed as at the initial time. The similar tests are implemented under environment at high temperature of 35° C. and high humidity of 65%, and at low temperature of 10° C. and low humidity of 15%, however, no remarkable deterioration of the quality of an image occurs and a satisfactory image can be formed stably. When toner in the vicinity of the surface of the toner carrier member is observed visually and with an electronic microscope after continuous printing of 3000 sheets, it is verified that colorant itself free from toner exists.

As described above, the result of the Experimental Example 19 shows that if colorant is detached from a toner base particle and stuck on the toner carrier member or even if further colorant detached from the toner base particle is free, toner can be kept in desired polarity, toner in reversed polarity can be prevented from occurring and that further, background fog can be prevented from occurring by keeping the relationship in an electrification rank as shown in FIG. 5F.

EXPERIMENTAL EXAMPLE 20

Next, an experimental example of the relationship in the electrification rank according to the fourth embodiment of the present invention, in the concrete, of a toner carrier member, an additive and a toner base particle in case an additive is not stuck on the surface of the toner carrier member according to the relationship in an electrification rank shown in FIGS. 4D and 4E according to the present invention will be described.

In this experiment, a toner carrier member shown in Table 37 is used.

TABLE 37

| Toner carrier member | Material |
|---|---|
| A | Urethane rubber (monolayer) |
| B | NBR (monolayer) |
| C | Base material: EPDM<br>Surface: urethane resin (two layers) |

Table 38 shows another characteristics of the above-described toner carrier member.

TABLE 38

| Toner carrier member | Hardness (JIS A) | Resistance (Ω) | Roughness of surface Rz (μm) |
|---|---|---|---|
| A | 45 | $5 \times 10^6$ | 6 |
| B | 50 | $1 \times 10^7$ | 5 |
| C | 48 | $1 \times 10^6$ | 3 |

In this experiment, an additive b formed by surface-treating silica with aminosilane is used in place of the additive d used in Experimental Example 18. The same supply member and layer thickness controlling member as in Experimental Example 18 are used. The same toner base particle D and colorant b as in Experimental Example 18 are also used. The toner carrier member is slightly closer to the negative side than additive b in an electrification rank as shown in FIG. 20. As a result of forming an image, evaluating the image and evaluating observation, a satisfactory image can be formed as in the Experimental Example 18.

EXPERIMENTAL EXAMPLE 21

Next, an experimental example of the case shown in FIG. 4F will be described.

In this experiment, the toner carrier member with quick stick on the surface, that is, the toner carrier member which is rough on the surface to the extent that the roughness has no effect on electrification of the toner carrier member so that an additive can be readily stuck on the toner carrier member is used. Table 39 shows the characteristics of the toner carrier member used in this experiment.

TABLE 39

| Toner carrier member | Hardness (JIS A) | Resistance (Ω) | Roughness of surface Rz (μm) |
|---|---|---|---|
| A' | 45 | $5 \times 10^6$ | 12 |

The same supply member and layer thickness controlling member as in the Experimental Example 20 are used. The same toner base particle D, additive b and colorant b as in Experimental Example 20 are also used. FIG. 20 shows the electrification rank of the members used in this experiment. Formation and evaluation of an image and evaluation of observation are also implemented as in the Experimental Example 20. As a result, a satisfactory image can be formed as in the Experimental Example 20.

As described above, even if both of colorant 4 detached from a toner base particle 3 and an additive 2 free from toner are stuck on the toner carrier member 1, toner can be kept in desired polarity, toner in reversed polarity can be prevented from occurring and further, background fog can be prevented from occurring by keep the relationship in a triboelectric series as shown in FIG. 4D.

EXPERIMENTAL EXAMPLE 22

Next, an experimental example of the relationship in an electrification rank according to the fourth embodiment of the present invention, in the concrete, of a toner carrier member, an additive and a toner base particle in case an additive is not stuck on the surface of the toner carrier member according to the relationship in an electrification rank shown in FIGS. 4G and 4H will be described.

Table 40 shows the characteristics of a toner carrier member used in this experiment.

TABLE 40

| Toner carrier member | Material |
|---|---|
| H | Silicon (monolayer) |

Table 41 shows another characteristics of the above-described toner carrier member.

TABLE 41

| Toner carrier member | Hardness (JIS A) | Resistance (Ω) | Roughness of surface Rz (μm) |
|---|---|---|---|
| H | 48 | $5 \times 10^5$ | 7 |

The same supply member and layer thickness controlling member as in the Experimental Example 18 are used. The toner base particle D, and colorant b as in the Experimental Example 18 are also used.

In this experiment, an additive b formed by surface-treating silica with aminosilane is used. The additive b is closer to the positive side than colorant b in an electrification rank as shown in FIG. 20. As a result of forming an image, evaluating the image and evaluating observation, a satisfactory image can be formed as in the Experimental Example 18. It is verified that colorant and an additive free from toner exist in toner in the vicinity of the toner carrier member.

EXPERIMENTAL EXAMPLE 23

Next, an experimental example of the case shown in FIG. 4I will be described.

In this experiment, the toner carrier member with quick stick on the surface, that is, the toner carrier member which is rough on the surface to the extent that the roughness has no effect on electrification of the toner carrier member so that an additive can be readily stuck on the toner carrier member is used. Table 42 shows the characteristics of the toner carrier member used in this experiment.

TABLE 42

| Toner carrier member | Hardness (JIS A) | Resistance (Ω) | Roughness of surface Rz (μm) |
|---|---|---|---|
| H' | 48 | $5 \times 10^5$ | 13 |

The same supply member and layer thickness controlling member as in the Experimental Example 22 are used. The same toner base particle D, additive b and colorant b as in the Experimental Example 22 are also used. FIG. 20 shows the electrification rank of the members used in this experiment. Formation and evaluation of an image and evaluation of observation are also implemented as in the Experimental Example 22. As a result, a satisfactory image can be formed as in the Experimental Example 22.

As described above, if both of colorant 4 detached from a toner base particle 3 and an additive 2 free from toner are stuck on the toner carrier member 1 or even if free colorant and a free additive exist, toner can be kept in desired polarity, toner in reversed polarity can be prevented from occurring and further, background fog can be prevented from occurring by keeping the relationship in a triboelectric series as shown in FIG. 4G.

EXPERIMENTAL EXAMPLE 24

Next, another experimental example of the relationship in an electrification rank according to the fourth embodiment of the present invention, in the concrete, of a toner carrier member, an additive and a toner base particle in case an additive is stuck on the surface of the toner carrier member according to the relationship in an electrification rank shown in FIGS. 4J and 4K will be described. In this experiment, an additive a formed by surface-treating with dimethyl silicone oil is used in place of the additive b used in the Experimental Example 23. In an electrification rank, the additive a is slightly closer to the negative side than colorant b as shown in FIG. 20. This experimental example is the same as the Experimental Example 23 except the above-described and as a result of forming an image, evaluating the image and evaluating observation, a satisfactory image can be formed as in the Experimental Example 23.

As described above, if detached colorant and a detached additive are stuck on the toner carrier member or even if free colorant and a free additive exist, toner can be kept in desired polarity, toner in reversed polarity can be prevented from occurring and further, background fog can be prevented from occurring by keeping the relationship in a triboelectric series as shown in FIG. 4J.

Although the above description has been made upon the case of reversal development, the present invention can be applied to the case of ordinary development. Although the above description has been made upon the relationship between the surface additives, the toner base particle and the toner carrier member, the same effect is obtained even in the case where the toner base particle in the aforementioned experimental examples is replaced by toner because the position of the triboelectric series of the toner base particle is almost equal to the position of the triboelectric series of toner.

Any magnetic, nonmagnetic, conductive or insulating material, such as metal, rubber, resin, etc., can be used as the toner carrier member 22 used according to the present invention as long as the material can be formed as a toner carrier member. For example, from the point of view of the quality of the material, metal such as aluminum, nickel, stainless steel, etc., rubber such as natural rubber, silicon rubber, urethane rubber, butadiene rubber, chloroprene rubber, neoprene rubber, NBR, etc., and resin such as styrol rein, vinyl chloride resin, polyurethane resin, polyethylene resin, methacrylic resin, Nylon resin, etc., can be used. From the point of view of the form of the material, any materials such as non-elastic matter, elastic matter, single-layer matter, multi-layer matter, film, roller, etc. can be used.

Like the toner carrier member 22, with respect to the supply member 19 and the toner layer (thickness) regulating member 25 used according to the present invention, any material from the double point of view of quality and form can be used. Further, as the toner 18 used according to the present invention, toner with the particle side of 5 to 20 μm as produced generally by a kneading and grinding method, a spray drying method or a polymerizing method can be used.

Toner proportion is not limited specifically, so that general proportion can be used. For example, as binding resin used is one member or a blend of two or more members selected from the group of polystyrene and copolymers, such as hydrogenated styrene resin, styrene-isobutylene copolymer, ABS resin, ASA resin, AS resin AAS resin, ACS resin, AES resin, styrene-P-chlorostyrene polymer, styrene-propylene copolymer, serene-butadiene crosslinking polymer, styrene-butadiene-chlorinated paraffin copolymer, styrene-acryl-alcohol copolymer, styrene-butadiene rubber emulsion, styrene-maleic ester copolymer, styrene-isobutylene copolymer, styrene-maleic anhydride copolymer, acrylate resin or methacrylate resin and copolymers thereof, styrene-acryl resin and copolymers thereof, such as styrene-acryl copolymer, styrene-diethylamino-ethylmethacrylate copolymer, styrene-butadiene-acrylic ester copolymer, styrene-methyl methacrylate copolymer, styrene-n-butyl methacrylate copolymer, styrene-diethylamino-ethyl methacrylate copolymer, styrene-methyl methacrylate-n-butyl acrylate copolymer, styrene-methyl methacrylate-butyl acrylate-N-(ethoxymethyl) acrylamide copolymer, styrene-glycidyl methacrylate copolymer, styrene-butadiene-dimethyl-aminoethyl methacrylate copolymer, styrene-acrylic ester-maleic ester copolymer, styrene-methyl methacrylate-2-ethylhexyl acrylate copolymer, styrene-n-butyl acrylate-ethylglycol methacrylate copolymer, styrene-n-butyl methacrylate-acrylic acid copolymer, styrene-n-butyl methacrylate-maleic anhydride copolymer, styrene-butyl acrylate-isobutyl maleic half ester-divinyl benzene copolymer, polyester and copolymers thereof, polyethylene and copolymers thereof, epoxy resin, silicone resin, polypropylene and copolymers thereof, fluorine resin, polyamide resin, polyvinyl alcohol resin, polyurethane resin, polyvinyl butyral resin, etc.

For colorant, the following colorant may be used: carbon black, spirit black, nigrosine, rhodamine, triamino triphenylmethane, cation, dioxazine, copper phthalocyanine, perylene, azoic dye, auriferous azo pigment, azo-chrome complex, carmine, benzidine, solar pure yellow 8G, quinacridon, polytungstic acid, indanthrene Blue, and sulfonamide derivative.

Further, metal soap, polyethylene glycol, etc. can be added as a dispersant. Electron-acceptance organic complex chlorinated polyester, nitrohumic acid, quarternary ammonium salts, pyridinium salts, etc. can be added as a charge control agent. The preferred as a magnetic agent is fine powder which has a particle size of not larger than 5 μm and is chemically stable when dispersed into the binding resin. Examples of the magnetic agent used include metal powder of Fe, Co, Ni, Cr and Mn; metal oxides such as $Fe_3O_4$, $Fe_2O_3$, $Cr_2O_3$, ferrite, etc.; alloys exhibiting ferromagnetism by heat treatment such as an alloy containing manganese and cooper, etc.; and so on. Pre-treatment with a coupling agent, etc. may be applied in advance.

Further, polypropylene wax, polyethylene wax, etc. can be added as a parting agent. Further, zinc stearate, zinc oxide, cerium oxide, etc. can be used as other additives. As the surface additives, various kinds of agents can be used. Examples of the surface additives used include: inorganic fine particles of metal oxides such as alumina, titanium oxide, etc., compound oxides thereof, and so on; and organic fine particles such as acrylic fine particles, etc.

Further, as surface treating agents therefor, silane coupling agents, titanate coupling agents, fluorine-containing silane coupling agents, silicone oil, and so on, can be used. The rate of hydrophobing of the surface additives treated with the aforementioned treating agent is preferably not smaller than 60% as a value measured by a conventional methanol method. If the rate is smaller than this value, lowering of frictional electric charges is undesirably caused by water adsorption under the condition of a high temperature and a high humidity.

The particle size of the surface additives is preferably in a range of from 0.001 to 1 Mm. The surface additives content is preferably in a range of from 0.1 to 5 wt % with respect to the toner base particle. Further, the volume resistance of the toner used according to the present invention is preferably not smaller than $10^{17}$ Ωcm.

With respect to the method of measuring resistance, after toner is pulverized and molded into a pellet with the thickness of 0.5 mm, electrodes are put on the upper and lower portions of the pellet. Then, a current value is measured when a voltage of 250 V is applied in the condition in which a load of 1 $Kg/cm^2$ is applied. Thereafter, the current value is converted into a volume resistance value.

The measurement is carried out in the inside of a dry desicator having the inside atmosphere replaced by a nitrogen atmosphere. Although the above description of the embodiments has been made upon a one-component forced contact development system having a tendency in which fogging in the ground occurs easily, the present invention is not limited thereto. Even in the case where the invention is applied to another development system such as a nonmagnetic non-contact development system, a magnetic contact development system, a magnetic non-contact development system, etc., fogging can be reduced similarly.

Although the above description of the embodiments has been made upon the case where one kind of surface additive is used or two kinds of surface additives are used (i.e. an additive and a colorant), the present invention can be applied to the case where more than two kinds of surface additives are mixed. That is, the case where the triboelectric series of a mixture of surface additives is used and the case where the respective triboelectric series of surface additives in a mixture are used are selected in accordance with the property of deposition thereof onto the toner carrier member. Fogging in the ground can be reduced by selecting surface additives under the consideration of these cases.

Although embodiment have been describe above, the present invention is not limited to the aforementioned embodiments. The present invention can be widely applied to image-forming apparatus using electronic photographic process. Particularly the invention is effective for application to printers, duplicators, facsimiles and displays.

As described above, according to the present invention, the triboelectric series of the toner carrier member, the toner base particle and the surface additives which are constituent member of a development system using negative toner have a relationship in which:

(1) The toner carrier member, the surface additives and the toner base particle are arranged in this order from the plus side;

(2) The toner carrier member, the toner base particle and the surface additives are arranged in this order from the plus side; and there is no adhesion between the surface additives and the toner carrier member; and (3) The toner base particle, the toner carrier member and the surface additives are arranged in this order from the plus side; the covering rate of the surface additives is high; and there is no adhesion between the surface additives and the toner carrier member, not only the toner base particle, the toner carrier member and the surface additives are arranged in this order from the plus side but the surface additives are not deposited on the toner carrier member.

Further, in the case of a development system using positive toner, the triboelectric series of the toner carrier member, the toner base particle and the surface additives have a relationship in which:

(1) The toner carrier member, the surface additives and the toner base particle are arranged in this order from the minus side;

(2) The toner carrier member, the toner base particle and the surface additives are arranged in this order from the minus side; the covering rate of the surface additives is high; and there is no adhesion between the surface additives and the toner carrier member, not only the toner base particle, the toner carrier member and the surface additives are arranged in this order from the plus side but the surface additives are not deposited on the toner carrier member.

Further, according to the present invention, when the relationship in an electrification rank among a toner carrier member, colorant, a toner base particle and an additive is as follows, the following effects can be produced:

1) when the polarity of colorant itself is the same as the electrification polarity of toner and colorant is inferior to a toner base particle in which the colorant is included in a triboelectric series, even if colorant is stuck on a toner carrier member, a toner base particle can be efficiently electrified;

2) when the polarity of colorant itself is the same as the electrification polarity of toner, colorant is inferior to a toner base particle in which the colorant is included in a triboelectric series and further, colorant is superior to a toner carrier member in a triboelectric series, even free colorant can be efficiently electrified;

3) when the polarity of colorant and an additive is the same as the electrification polarity of toner and they are inferior to a toner base particle in a triboelectric series, even if colorant and an additive are stuck on a toner carrier member, a toner base particle can be efficiently electrified;

4) when the polarity of colorant and an additive is the same as the electrification polarity of toner and they are inferior to a toner base particle in a triboelectric series and further, they is superior to a toner carrier member in a triboelectric series, even if colorant and an additive are stuck on a toner carrier member, free colorant and a free additive can be efficiently electrified; and 5) when the polarity of colorant and an additive is the same as the electrification polarity of toner and they are inferior to a toner base particle in a triboelectric series, further, they are superior to a toner carrier member in a triboelectric series and furthermore, an additive is inferior to colorant in a triboelectric series, even if an additive is stuck on a toner carrier member, free colorant can be efficiently electrified.

From the above description, the invention has an effect in that a high-quality image can be formed because production of reverse polarity toner can be prevented so that deterioration of image quality caused by fogging is eliminated. Further, there arises an effect in that a high-quality image free from fogging can be formed stably against the change of time and the change of environment. Further, there arises an effect in that a good image free from fogging can be formed relatively easily by using various kinds of materials because a range for selecting materials is widened by application of the present invention.

I claim:

1. A method of developing an image from an electrostatic latent image formed on an image portion of a latent image carrier which is charged to a predetermined potential, the method comprising the steps of:

supplying to a toner carrier member, toner comprising toner base particles, a first additive constituted by fine particles, and a second additive constituted by fine particles, wherein respective potentials of the toner carrier member, the toner base particles, the first additive and the second additive have a predetermined triboelectric series;

using the predetermined triboelectric series to transfer the toner from the toner carrier member to the image portion of the latent image carrier so that fogging is substantially reduced; and developing the image from the transferred toner.

2. The method according to claim 1, wherein the toner is negative toner and wherein the triboelectric series of the toner carrier member, the toner bases particles and the first additive is in the following order from the plus side: the toner carrier member, the first additive and the toner base particles.

3. The method according to claim 2, wherein the second additive is a colorant.

4. The method according to claim 3, wherein the colorant is quinacridon colorant.

5. The method according to claim 2, wherein the triboelectric series of the second additive is greater than the triboelectric series of the toner carrier member from the plus side.

6. The method according to claim 2, wherein the triboelectric series of the second additive is less than the triboelectric series of the toner carrier member from the plus side.

7. The method according to claim 2, wherein the triboelectric series of the second additive is less than the triboelectric series of the first additive from the plus side.

8. The method according to claim 2, wherein the triboelectric series of the second additive is greater than the triboelectric series of the toner base particles from the plus side.

9. The method according to claim 2, wherein said first surface additive is made of fine particles treated with silicone oil.

10. The method according to claim 2, wherein said toner carrier member includes a layer of Nylon.

11. The method according to claim 2, wherein said toner carrier member includes an EPDM layer.

12. The method according to claim 2, wherein said toner carrier member is made of a metal.

13. The method according to claim 2, wherein a supply member for supplying the toner to the toner carrier member has a greater triboelectric series from the plus side than the second additive.

14. The method according to claim 2, wherein a toner layer regulating member, for regulating the thickness of the toner on the toner carrier member, has a greater triboelectric series from the plus side than the second additive.

15. The method according to claim 1, wherein toner is a negative toner and wherein the triboelectric series of the toner carrier member, the toner bases particles and the first additive is in the following order from the plus side: the toner carrier member, the toner base particles, and the first additive.

16. The method according to claim 15, wherein the second additive is a colorant.

17. The method according to claim 16, wherein the colorant is quinacridon colorant.

18. The method according to claim 15, wherein the triboelectric series of the second additive is greater than the triboelectric series of the toner carrier member from the plus side.

19. The method according to claim 15, wherein the triboelectric series of the second additive is less than the triboelectric series of the toner carrier member from the plus side.

20. The method according to claim 15, wherein the triboelectric series of the second additive is greater than the triboelectric series of the first additive from the plus side.

21. The method according to claim 15, wherein the triboelectric series of the second additive is greater than the triboelectric series of the toner base particles from the plus side.

22. The method according to claim 15, wherein the first surface additive is made of fine particles treated with hexamethyldisilazane.

23. The method according to claim 15, wherein said toner carrier member includes a layer of Nylon.

24. The method according to claim 15, wherein said toner carrier member includes an EPDM layer.

25. The method according to claim 15, wherein said toner carrier member is made of a metal.

26. The method according to claim 15, wherein a supply member for supplying the toner to the toner carrier member has a greater triboelectric series from the plus side than the toner base particles.

27. The method according to claim 15, wherein a toner layer regulating member, for regulating the thickness of the toner on the toner carrier member, has a greater triboelectric series from the plus side than the toner base particles.

28. The method according to claim 1, wherein the toner is positive toner and wherein the triboelectric series of the toner carrier member, the toner bases particles and the first additive is in the following order from the minus side: the toner carrier member, the first additive and the toner base particles.

29. The method according to claim 28, wherein the second additive is a colorant.

30. The method according to claim 29, wherein the colorant is rhodamine colorant.

31. The method according to claim 28, wherein the triboelectric series of the second additive is greater than the triboelectric series of the toner carrier member from the minus side.

32. The method according to claim 28, wherein the triboelectric series of the second additive is less than the triboelectric series of the toner carrier member from the minus side.

33. The method according to claim 28, wherein the triboelectric series of the second additive is less than the triboelectric series of the first additive from the minus side.

34. The method according to claim 28, wherein the triboelectric series of the second additive is greater than the triboelectric series of the toner base particles from the minus side.

35. The method according to claim 28, wherein the first surface additive is made of fine particles treated with aminosilane.

36. The method according to claim 28, wherein said toner carrier member includes a layer of silicone.

37. The method according to claim 28, wherein said toner carrier member includes a layer of urethane rubber.

38. The method according to claim 28, wherein said toner carrier member includes an EPDM layer.

39. The method according to claim 28, wherein said toner carrier member includes an NBR layer.

40. The method according to claim 28, wherein a supply member for supplying the toner to the toner carrier member has a greater triboelectric series from the minus side than the second additive.

41. The method according to claim 28, wherein a toner layer regulating member, for regulating the thickness of the toner on the toner carrier member, has a greater triboelectric series from the minus side than the second additive.

42. The method according to claim 1, wherein the toner is positive toner and wherein the triboelectric series of the toner carrier member, the toner bases particles and the first additive is in the following order from the minus side: the toner carrier member, the toner base particles, and the first additive.

43. The method according to claim 42, wherein the second additive is a colorant.

44. The method according to claim 42, wherein the colorant is rhodamine colorant.

45. The method according to claim 42, wherein the triboelectric series of the second additive is greater than the triboelectric series of the toner carrier member from the minus side.

46. The method according to claim 42, wherein the triboelectric series of the second additive is less than the triboelectric series of the toner carrier member from the minus side.

47. The method according to claim 42, wherein the triboelectric series of the second additive is greater than the triboelectric series of the first additive from the minus side.

48. The method according to claim 42, wherein the triboelectric series of the second additive is greater than the triboelectric series of the toner base particles from the minus side.

49. The method according to claim 42, wherein said surface additives is made of fine particles of treated with aminosilane and octylsilane.

50. The method according to claim 42, wherein said toner carrier member includes a layer of silicone.

51. The method according to claim 42, wherein said toner carrier member includes a layer of urethane rubber.

52. The method according to claim 42, wherein said toner carrier member includes an EPDM layer.

53. The method according to claim 42, wherein said toner carrier member includes an NBR layer.

54. The method according to claim 42, wherein said toner carrier member has a surface made of a fluorine compound.

55. The method according to claim 42, wherein a supply member for supplying the toner to the toner carrier member has a greater triboelectric series from the minus side than the toner base particles.

56. The method according to claim 42, wherein a toner layer regulating member, for regulating the thickness of the toner on the toner carrier member, has a greater triboelectric series from the minus side than the toner base particles.

57. A developing system, comprising:

toner comprising toner base particles, a first additive and a second additive;

means for forming an image;

a latent image carrier having a photosensitive layer onto which a latent image is formed by said image forming means, said latent image carrier rotating along a first shaft;

a toner carrier member for conveying said toner to said latent image carrier, said toner carrier member contacting said latent image carrier and rotating along a second shaft parallel with said first shaft, wherein respective potentials of the toner carrier member, the toner base particles, the first additive and the second additive have a predetermined triboelectric series which is used to facilitate transfer of the toner to the latent image carrier so that fogging is substantially reduced; and a toner supply member for supplying said toner to said toner carrier member, said toner supply member contacting said toner carrier member and rotating along a third shaft parallel with said first and second shafts.

58. The developing system of claim 57, wherein said image forming means comprises a light source and an image-forming optical system.

59. The developing system of claim 57, further comprising a plate-like regulating member for limiting an amount of toner on said toner carrier member, said regulating member being constituted by one of: nonmagnetic metal, magnetic metal, nonmagnetic resin and magnetic resin.

60. The developing system of claim 57, wherein said toner supply member comprises a foamed material.

61. The system according to claim 57, wherein the toner is negative toner and wherein the triboelectric series of the toner carrier member, the toner bases particles and the first additive is in the following order from the plus side: the toner carrier member, the first additive and the toner base particles.

62. The system according to claim 61, wherein the second additive is a colorant.

63. The system according to claim 61, wherein the triboelectric series of the second additive is greater than the triboelectric series of the toner carrier member from the plus side.

64. The system according to claim 61, wherein the triboelectric series of the second additive is less than the triboelectric series of the toner carrier member from the plus side.

65. The system according to claim 61, wherein the triboelectric series of the second additive is less than the triboelectric series of the first additive from the plus side.

66. The system according to claim 61, wherein the triboelectric series of the second additive is greater than the triboelectric series of the toner base particles from the plus side.

67. The system according to claim 61, wherein the toner supply member, has a greater triboelectric series from the plus side than the second additive.

68. The system according to claim 57, wherein the toner is a negative toner and wherein the triboelectric series of the toner carrier member, the toner bases particles and the first additive is in the following order from the plus side: the toner carrier member, the toner base particles, and the first additive.

69. The system according to claim 68, wherein the second additive is a colorant.

70. The system according to claim 68, wherein the triboelectric series of the second additive is greater than the triboelectric series of the toner carrier member from the plus side.

71. The system according to claim 68, wherein the triboelectric series of the second additive is less than the triboelectric series of the toner carrier member from the plus side.

72. The system according to claim 68, wherein the triboelectric series of the second additive is greater than the triboelectric series of the first additive from the plus side.

73. The system according to claim 68, wherein the triboelectric series of the second additive is greater than the triboelectric series of the toner base particles from the plus side.

74. The system according to claim 68, wherein the toner supply member has a greater triboelectric series from the plus side than the toner base particles.

75. The system according to claim 57, wherein the toner is positive toner and wherein the triboelectric series of the toner carrier member, the toner bases particles and the first additive is in the following order from the minus side: the toner carrier member, the first additive and the toner base particles.

76. The system according to claim 75, wherein the second additive is a colorant.

77. The system according to claim 75, wherein the triboelectric series of the second additive is greater than the triboelectric series of the toner carrier member from the minus side.

78. The system according to claim 75, wherein the triboelectric series of the second additive is less than the triboelectric series of the toner carrier member from the minus side.

79. The system according to claim 75, wherein the triboelectric series of the second additive is less than the triboelectric series of the first additive from the minus side.

80. The system according to claim 75, wherein the triboelectric series of the second additive is greater than the triboelectric series of the toner base particles from the minus side.

81. The system according to claim 75, wherein the toner supply member has a greater triboelectric series from the minus side than the second additive.

82. The system according to claim 57, wherein the toner is positive toner and wherein the triboelectric series of the toner carrier member, the toner bases particles and the first additive is in the following order from the minus side:

the toner carrier member, the toner base particles, and the first additive.

83. The system according to claim 82, wherein the second additive is a colorant.

84. The system according to claim 82, wherein the triboelectric series of the second additive is greater than the triboelectric series of the toner carrier member from the minus side.

85. The system according to claim 82, wherein the triboelectric series of the second additive is less than the triboelectric series of the toner carrier member from the minus side.

86. The system according to claim 82, wherein the triboelectric series of the second additive is greater than the triboelectric series of the first additive from the minus side.

87. The system according to claim 82, wherein the triboelectric series of the second additive is greater than the triboelectric series of the toner base particles from the minus side.

88. The system according to claim 82, wherein the toner supply member has a greater triboelectric series from the minus side than the toner base particles.

89. The system according to claim 61, wherein the toner layer regulating member has a greater triboelectric series from the plus side than the second additive.

90. The system according to claim 68, wherein the toner layer regulating member has a greater triboelectric series from the plus side than the toner base particles.

91. The system according to claim 75, wherein the toner layer regulating member has a greater triboelectric series from the minus side than the second additive.

92. The system according to claim 82, wherein the toner layer regulating member has a greater triboelectric series from the minus side than the toner base particles.

* * * * *